US007423499B2

(12) United States Patent
Adachi et al.

(10) Patent No.: US 7,423,499 B2
(45) Date of Patent: Sep. 9, 2008

(54) HIGH-FREQUENCY SWITCHING APPARATUS

(75) Inventors: Masakazu Adachi, Osaka (JP); Tadayoshi Nakatsuka, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 115 days.

(21) Appl. No.: 11/546,260

(22) Filed: Oct. 12, 2006

(65) Prior Publication Data

US 2007/0096845 A1 May 3, 2007

(30) Foreign Application Priority Data

Oct. 14, 2005 (JP) ..... 2005-299721

(51) Int. Cl.
*H01P 1/10* (2006.01)
*H01P 1/15* (2006.01)

(52) U.S. Cl. ..... 333/103; 333/101

(58) Field of Classification Search ..... 333/101, 333/103, 262

See application file for complete search history.

(56) References Cited

U.S. PATENT DOCUMENTS 7,337,547 B2 * 3/2008 Yasuda et al. ..... 333/103

FOREIGN PATENT DOCUMENTS

JP 08139014 5/1996
JP 08213893 8/1996

* cited by examiner

*Primary Examiner*—Dean O Takaoka
(74) *Attorney, Agent, or Firm*—Dickinson Wright, PLLC

(57) ABSTRACT

A high-frequency switching apparatus is composed of a transfer circuit unit including a plurality of FETs, and a shunt circuit unit including a plurality of FETs, as well. An electromagnetic wave absorption material element is connected to an end of the shunt circuit unit. To a connection point between the shunt circuit unit and the electromagnetic wave absorption material element, an external voltage terminal for fixing a potential at the point is connected. By this, a high-frequency switching apparatus is obtained which is excellent in isolation characteristics and is hard to break down even when a signal of a high voltage, such as an electrostatic surge, flows into the apparatus.

18 Claims, 18 Drawing Sheets

HIGH-FREQUENCY SWITCHING APPARATUS

BACKGROUND OF THE INVENTION

1. Field of the Invention

The present invention relates to a high-frequency switching apparatus that performs, for example, switching between on and off states of a signal path or between a plurality of signal paths in a mobile communication device and the like.

2. Description of the Background Art

FIG. 17 is an equivalent circuit diagram of a SPDT (Single-Pole Double-Throw) high-frequency switching apparatus which is one of conventional art high-frequency switching apparatuses (see, for example, page 4 and FIG. 1 of Japanese Laid-Open Patent Publication No. 8-139014). In FIG. 17, reference numerals FET11 to FET14 and FET21 to FET24 each denote a depression-type field-effect transistor (hereinafter, simply referred to as a "field-effect transistor"). Reference numerals Rt11 to Rt14 and Rt21 to Rt24 each denote a resistor. Reference numeral IN11 denotes a signal input terminal. Reference numerals OUT11 and OUT12 denote a first and a second signal output terminals, respectively. Reference numerals Vcnt11 and Vcnt12 denote a first and a second control voltage terminals, respectively. Reference numeral TF11 denotes a first transfer circuit. Reference numeral TF12 denotes a second transfer circuit.

In this configuration, when, for example, a voltage of 3 volts and a voltage of 0 volt are applied to the first control voltage terminal Vcnt11 and the second control voltage terminal Vcnt12, respectively, the field-effect transistors FET11 to FET14 go into anon state and the field-effect transistors FET21 to FET24 go into an off state. This makes it possible to bring a path from the signal input terminal IN11 to the signal output terminal OUT11 into a conduction state (on path) and to bring a path from the signal input terminal IN11 to the signal output terminal OUT12 into a cutoff state (off path).

In the above conventional art configuration, although in the off path the field-effect transistors FET21 to FET24 are in the off state, when a large signal of 30 dBm or more is used, a signal leaking to the second signal output terminal OUT12 through the field-effect transistors FET21 to FET24 is great. Thus, the isolation characteristics are poor and an apparatus that is connected to a stage subsequent to the second signal output terminal OUT12 and that composes a receiving circuit and the like may possibly break down.

On page 4 and in FIG. 1 of Japanese Laid-Open Patent Publication No. 8-213893, to circumvent such a problem, as shown in FIG. 18, shunt circuit units SH11 and SH12 are connected to a first and a second signal output terminals OUT11 and OUT12, respectively, and ends of the respective shunt circuit units SH11 and SH12 are connected to ground GND via DC cut capacitors C12 and C13, respectively. The shunt circuit units SH11 and SH12 are controlled to be in opposite phase to their corresponding transfer circuit units TF11 and TF12 present in paths leading to the signal output terminals OUT11 and OUT12, respectively. By this, signals leaking from the transfer circuit units TF11 and TF12 flow to the ground GND, making it possible to prevent the signals from flowing into a receiving circuit and the like.

However, since inductance components, such as a package and wires, are added between the ground GND and the capacitors C12 and C13 or between the ground GND and field-effect transistors FET15 and FET25 to which the capacitors C12 and C13 are connected, respectively, excellent isolation characteristics cannot be obtained. Besides, capacitors formed by a semiconductor process have a problem that the ESD breakdown voltage (electrostatic breakdown voltage) significantly deteriorates.

SUMMARY OF THE INVENTION

Thus, an object of the present invention is to provide a high-frequency switching apparatus capable of improving the isolation characteristics as compared with conventional art apparatuses.

Another object of the present invention is to provide a high-frequency switching apparatus capable of improving the ESD breakdown voltage as compared with the configuration using DC cut capacitors.

To solve the above-described problems, in the present invention, a high-frequency switching apparatus is composed of a transfer circuit unit and a shunt circuit unit and an electromagnetic wave absorption material element is provided to an end of the shunt circuit unit. By this, a high-frequency switching apparatus can be provided which is excellent in isolation characteristics as compared with conventional art configurations and further excellent in ESD breakdown voltage, and is hard to break down even when a signal of a high voltage, such as an electrostatic surge, flows into the apparatus.

A first high-frequency switching apparatus of the present invention comprises an input/output control circuit including: a first and a second input/output terminals; a transfer circuit unit composed of a first switching circuit and connected to the first input/output terminal at its one end and to the second input/output terminal at its other end, the first switching circuit including a first field-effect transistor; a shunt circuit unit composed of a second switching circuit and connected to the second input/output terminal at its one end, the second switching circuit including a second field-effect transistor; and an electromagnetic wave absorption material element connected to an other end of the shunt circuit unit, wherein by applying one of a high level voltage and a low level voltage to a gate of the first field-effect transistor and a gate of the second field-effect transistor such that the applied voltages are in opposite phase, a path between the first input/output terminal and the second input/output terminal is switched between a conduction state and a cutoff state.

A second high-frequency switching apparatus of the present invention may be such that in the first high-frequency switching apparatus of the present invention, a plurality of the input/output control circuits are provided, and the first input/output terminals of the respective input/output control circuits are disposed into one first input/output terminal for shared use between the input/output control circuits, and the second input/output terminals of the respective input/output control circuits are disposed independently.

A third high-frequency switching apparatus of the present invention may be such that in the first high-frequency switching apparatus of the present invention, the electromagnetic wave absorption material element is provided for shared use between the input/output control circuits.

A fourth high-frequency switching apparatus of the present invention may be such that in the second high-frequency switching apparatus of the present invention, the other ends of the respective shunt circuit units included in the input/output control circuits are connected to a first electrode in a shared manner and the first electrode is connected to the electromagnetic wave absorption material element.

A fifth high-frequency switching apparatus of the present invention may be such that in the first high-frequency switching apparatus of the present invention, the input/output control circuit is formed on a semiconductor chip.

A sixth high-frequency switching apparatus of the present invention may be such that in the first high-frequency switching apparatus of the present invention, the electromagnetic wave absorption material element included in the input/output control circuit is formed on a first semiconductor chip, the input/-output control circuit, excluding the electromagnetic wave absorption material element, is formed on a second semiconductor chip, and the first and the second semiconductor chips are packaged in a same package.

A seventh high-frequency switching apparatus of the present invention may be such that in the first high-frequency switching apparatus of the present invention, the input/output control circuit, excluding the electromagnetic wave absorption material element, is formed on a semiconductor chip, the electromagnetic wave absorption material element having a larger area than the semiconductor chip is formed on a mounting substrate, the semiconductor chip is mounted on the electromagnetic wave absorption material element, and the semiconductor chip is connected to the electromagnetic wave absorption material element via a second electrode formed on the electromagnetic wave absorption material element.

An eighth high-frequency switching apparatus of the present invention may be such that in the seventh high-frequency switching apparatus of the present invention, a third electrode is formed in a lower layer on the mounting substrate than the electromagnetic wave absorption material element, the third electrode is connected to a ground potential, and the second electrode is disposed on the electromagnetic wave absorption material element so as to face the third electrode.

A ninth high-frequency switching apparatus of the present invention may be such that in the first high-frequency switching apparatus of the present invention, the input/output control circuit, excluding the electromagnetic wave absorption material element, is formed on a surface of a semiconductor chip, an inner via connected to the shunt circuit unit is formed in the semiconductor chip, a second electrode is formed on a backside of the semiconductor chip, the inner via and the second electrode are connected to each other, and the electromagnetic wave absorption material element is formed on the backside of the semiconductor chip so as to include, as viewed in a projective manner from a top, the second electrode.

A tenth high-frequency switching apparatus of the present invention may be such that in the first high-frequency switching apparatus of the present invention, the input/output control circuit, excluding the electromagnetic wave absorption material element, is formed on a surface of a semiconductor chip, an inner via connected to the shunt circuit unit is formed in the semiconductor chip, a second electrode is formed on a backside of the semiconductor chip, the second electrode is connected to the inner via, and the electromagnetic wave absorption material element is formed so as to include an entire backside of the semiconductor chip.

An eleventh high-frequency switching apparatus of the present invention may be such that in the ninth high-frequency switching apparatus of the present invention, the semiconductor chip is flip-chip mounted.

A twelfth high-frequency switching apparatus of the present invention may be such that in the tenth high-frequency switching apparatus of the present invention, the semiconductor chip is flip-chip mounted.

A thirteenth high-frequency switching apparatus of the present invention may be such that in the seventh high-frequency switching apparatus of the present invention, a third electrode connected to a ground potential is formed between the semiconductor chip and the electromagnetic wave absorption material element, and the third electrode is insulated from the second electrode.

A fourteenth high-frequency switching apparatus of the present invention may be such that in the eighth high-frequency switching apparatus of the present invention, a fourth electrode connected to the ground potential is formed between the semiconductor chip and the electromagnetic wave absorption material element, and the fourth electrode is insulated from the second electrode.

A fifteenth high-frequency switching apparatus of the present invention may be such that in the ninth high-frequency switching apparatus of the present invention, a third electrode connected to a ground potential is formed between the semiconductor chip and the electromagnetic wave absorption material element, and the third electrode is insulated from the second electrode.

A sixteenth high-frequency switching apparatus of the present invention may be such that in the tenth high-frequency switching apparatus of the present invention, a third electrode connected to a ground potential is formed between the semiconductor chip and the electromagnetic wave absorption material element, and the third electrode is insulated from the second electrode.

A seventeenth high-frequency switching apparatus of the present invention may be such that in the first high-frequency switching apparatus of the present invention, a potential at a connection point between the shunt circuit unit and the electromagnetic wave absorption material element is fixed.

According to this configuration, excellent high-frequency characteristics are obtained.

An eighteenth high-frequency switching apparatus of the present invention may be such that in the first high-frequency switching apparatus of the present invention, the first switching circuit is composed of a circuit in which a plurality of the first field-effect transistors are connected to one another in series and the second switching circuit is composed of a circuit in which a plurality of the second field-effect transistors are connected to one another in series.

According to this configuration, the electric power of a high-frequency signal to be used can be increased.

As described above, according to the present invention, in a high-frequency switching apparatus, a signal that leaks from a transfer circuit unit being in an off state can be absorbed by an electromagnetic wave absorption material element provided to a shunt circuit unit. Thus, the isolation characteristics can be improved as compared with those obtained by conventional art apparatuses. In addition, the ESD breakdown voltage can be improved as compared with the configuration using DC cut capacitors.

DESCRIPTION OF THE PREFERRED EMBODIMENTS

Embodiments of the present invention will be described below with reference to the drawings.

First Embodiment

Figure 1:
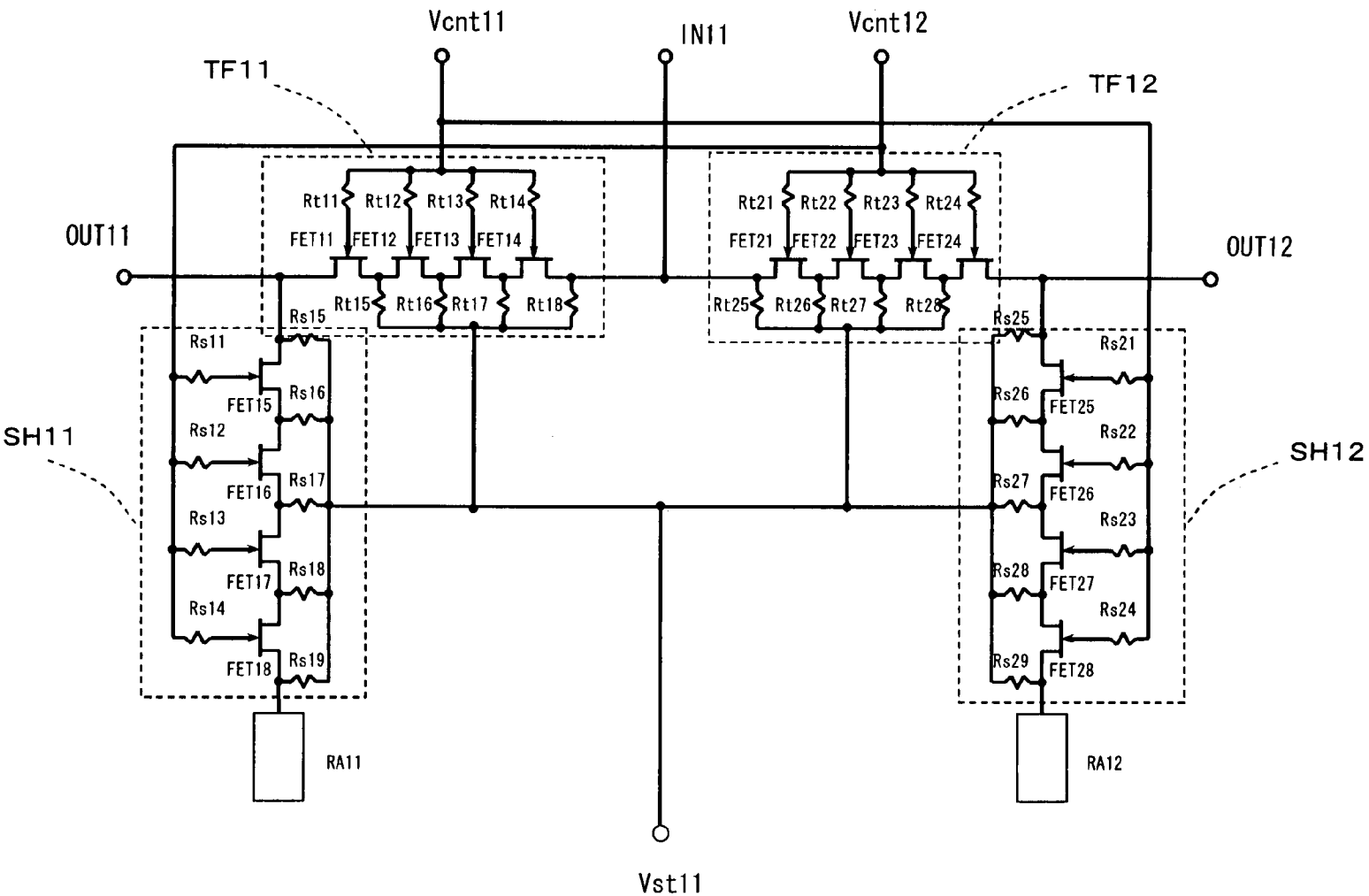
FIG. 1 is a circuit diagram showing an equivalent circuit of a SPDT high-frequency switching apparatus according to a first embodiment of the present invention.

FIG. 1 is an equivalent circuit diagram of a SPDT high-frequency switching apparatus which is one of high-frequency switching apparatuses according to a first embodiment.

In FIG. 1, reference numerals TF11 and TF12 each denote a transfer circuit unit composed of a field-effect transistor switching circuit. Reference numerals SH11 and SH12 each denote a shunt circuit unit composed of a field-effect transistor switching circuit. Reference numerals FET11 to FET18 and FET21 to FET28 each denote a depression-type field-effect transistor (hereinafter, referred to as a "field-effect transistor"). Reference numerals Rt11 to Rt18, Rt21 to Rt28, Rs11 to Rs19, and Rs21 to Rs29 each denote a resistor. Reference numeral IN11 denotes a signal input terminal. Reference numerals OUT11 and OUT12 denote a first and a second signal output terminals, respectively. Reference numerals Vcnt11 and Vcnt12 denote a first and a second control voltage terminals, respectively. Reference numeral Vst11 denotes a voltage fixing terminal. Reference numerals RA11 and RA12 each denote an electromagnetic wave absorption material element.

In the SPDT high-frequency switching apparatus, the signal input terminal IN11 and the first and the second signal output terminals OUT11 and OUT12 are connected to an external circuit, e.g., an antenna or a receiving circuit unit. The SPDT high-frequency switching apparatus has a function of switching between a path through which a signal is transferred from the signal input terminal IN11 to the first signal output terminal OUT11 and a path through which a signal is transferred from the signal input terminal IN11 to the second signal output terminal OUT12, by external voltages to be applied to the first and the second control voltage terminals Vcnt11 and Vcnt12.

Figure 2:
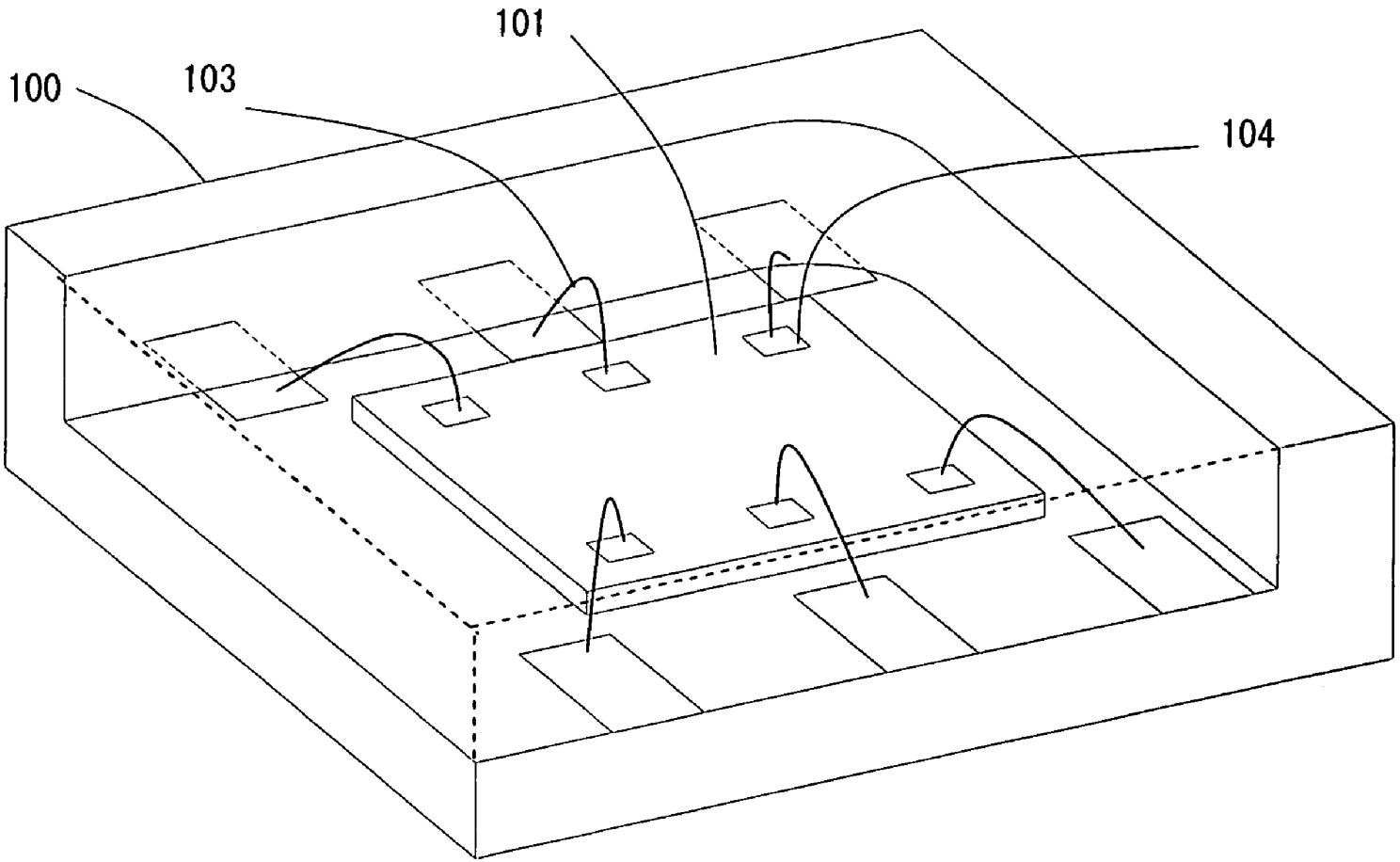
FIG. 2 is a perspective view showing the inside of a package of the SPDT high-frequency switching apparatus according to the first embodiment of the present invention.

FIG. 2 is a perspective view of the SPDT high-frequency switching apparatus according to the first embodiment. In FIG. 2, reference numeral 100 denotes a package of the SPDT high-frequency switching apparatus. Reference numeral 101 denotes a semiconductor chip having the SPDT high-frequency switching apparatus integrated on a semiconductor substrate. Reference numeral 103 denotes a wire. Reference numeral 104 denotes an electrode on the semiconductor chip 101.

The semiconductor chip 101 is packaged in the package 100 by a die bond or a wire bond and sealed with an epoxy resin.

Figure 3A:
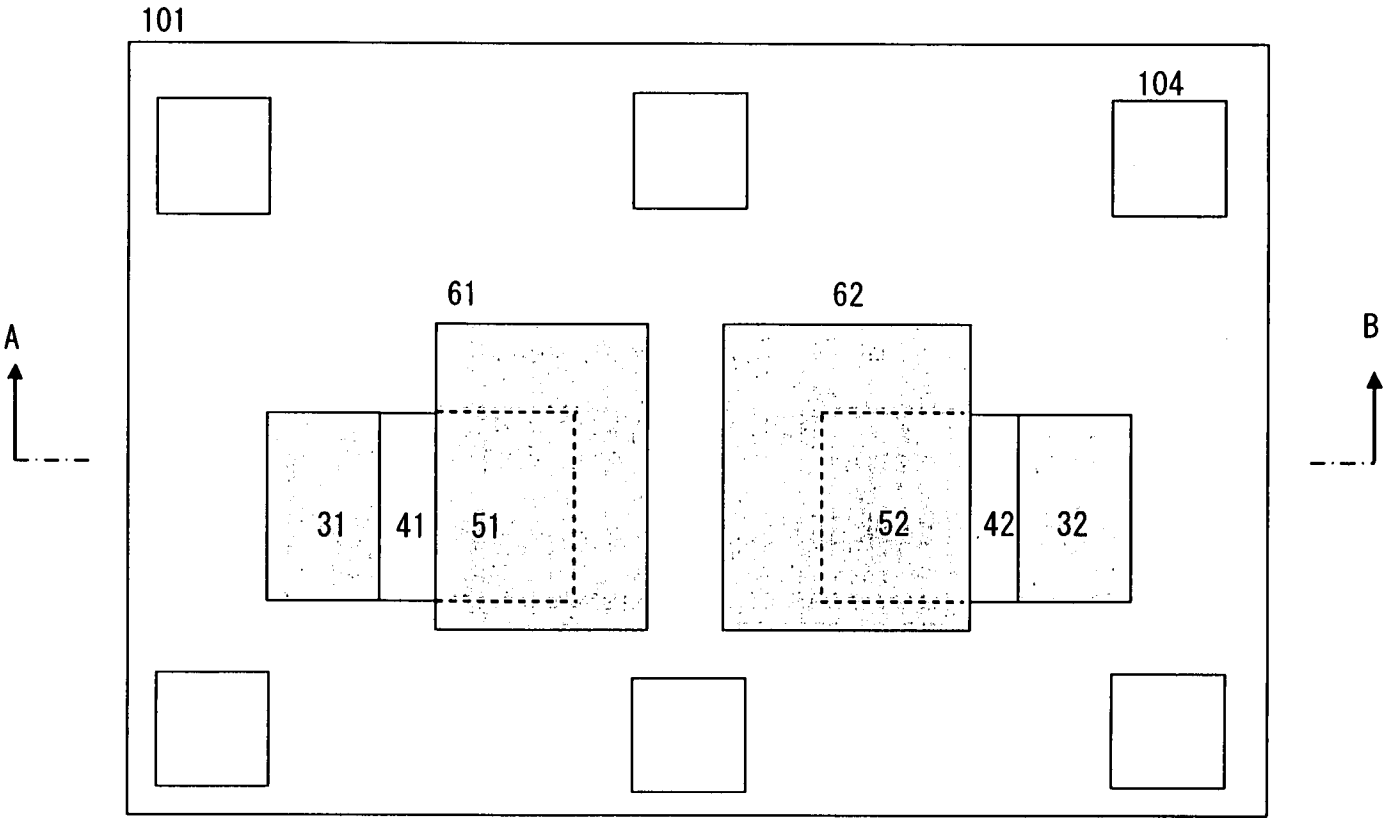
FIGS. 3A and 3B are a top view and a cross-sectional view, respectively, of a semiconductor chip that composes the SPDT high-frequency switching apparatus according to the first embodiment of the present invention.
Figure 3B:
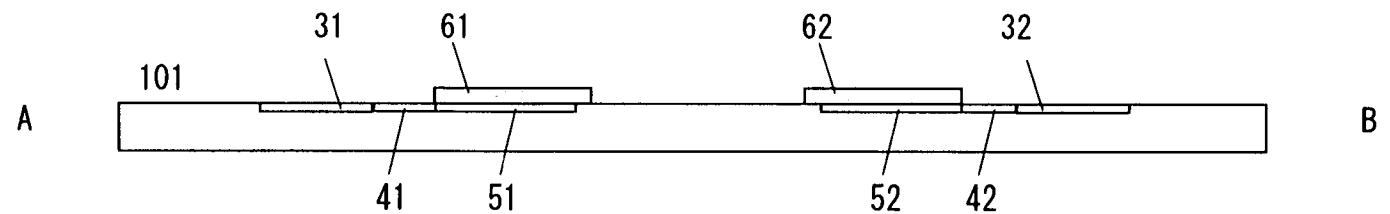

FIG. 3A is a top view of the semiconductor chip 101 composing the SPDT high-frequency switching apparatus according to the first embodiment. FIG. 3B is a cross-sectional view taken along a line A-B of the semiconductor chip 101. In FIGS. 3A and 3B, reference numerals 31 and 32 denote shunt circuit units shown in FIG. 1. Reference numerals 41 and 42 denote electrical wiring. Reference numerals 51 and 52 each denote an electrode of an electromagnetic wave absorption material element. Reference numerals 61 and 62 denote electromagnetic wave absorption material elements formed on the semiconductor chip 101 including on the electrodes 51 and 52 respectively.

The semiconductor chip 101 uses GaAs as a main material. The electromagnetic wave absorption material elements 61 and 62 are formed by depositing, by an ECR sputtering technique, an electromagnetic wave absorption material, e.g., a ferrite-based material, on the electrodes 51 and 52 connected to the shunt circuit units 31 and 32 via the electrical wiring 41 and 42, respectively, to a thickness of 10 micrometers. The electromagnetic wave absorption material elements are divided into one formed of a dielectric material and one formed of a magnetic material; the former uses dielectric loss and the latter uses magnetic loss, to convert an electromagnetic wave into heat. By this operation, a signal having leaked from a transfer circuit unit being in an off state is absorbed by an electromagnetic wave absorption material element through a shunt circuit unit.

Here, it is desirable that the potential at a connection point between the shunt circuit unit and the electromagnetic wave absorption material element be fixed. This is because by fixing the potential at the connection point, excellent high-frequency characteristics are obtained. Hence, if there is no problem in high-frequency characteristics, the potential at the connection point does not need to be fixed.

Figure 4:
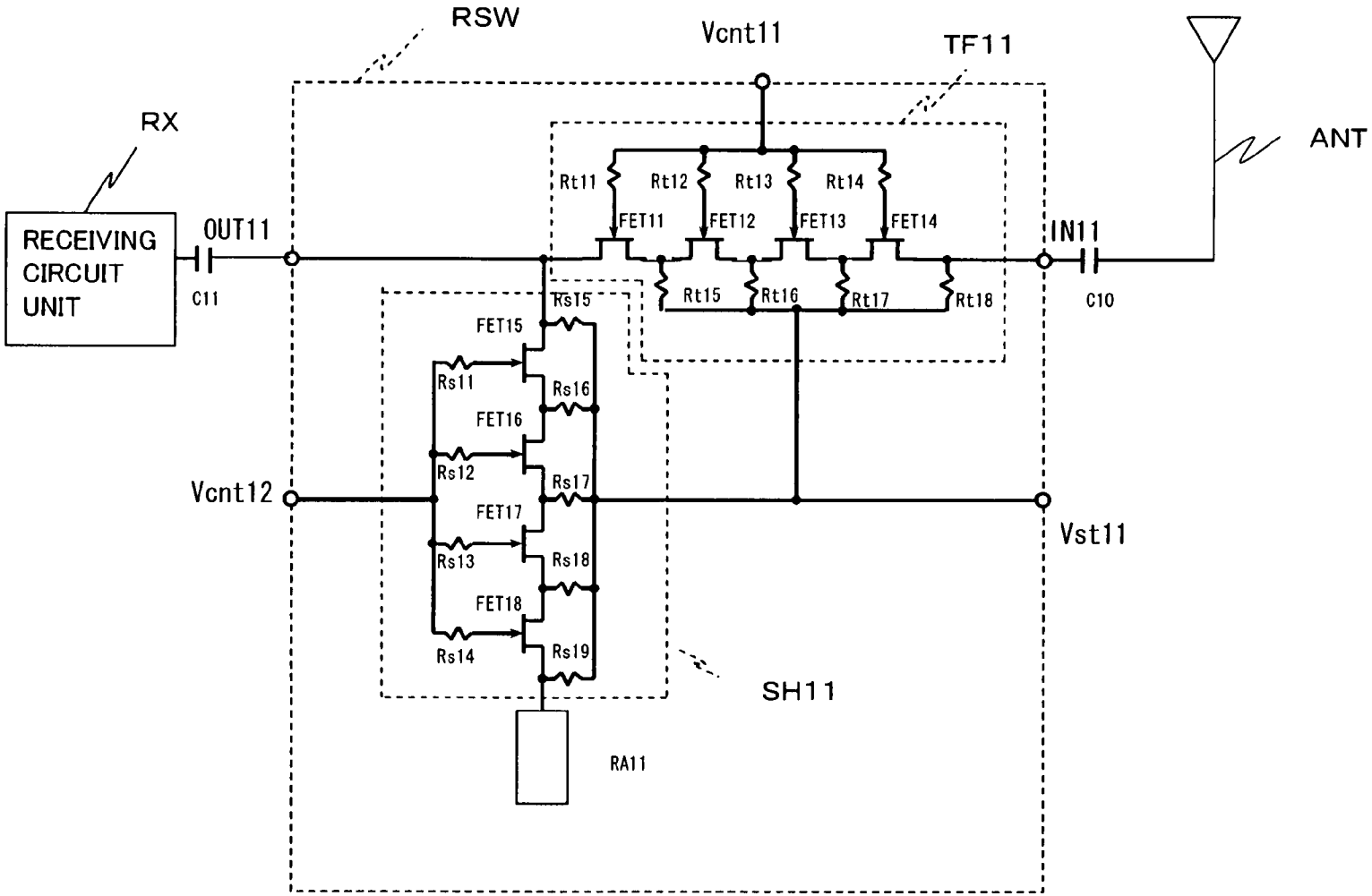
FIG. 4 is a circuit diagram showing an equivalent circuit of a SPST switching apparatus according to the first embodiment of the present invention and peripheral units thereof.

FIG. 4 is an equivalent circuit diagram of a SPST (Single-Pole Single-Throw) high-frequency switching apparatus which is the most basics upon composing a high-frequency switching apparatus in a circuit, and peripheral units thereof. Referring to FIG. 4, the basic configuration of a reception switching circuit RSW and an operation thereof will be described using the case, as an example, in which a communication device, such as a mobile phone, receives a signal from an antenna ANT and transfers the signal to a receiving circuit unit RX.

The SPST high-frequency switching apparatus is composed of a transfer circuit unit TF11 and a shunt circuit unit SH11.

The transfer circuit unit TF11 includes depression-type field-effect transistors (hereinafter, referred to as "field-effect transistors") FET11 to FET14. Source terminals and drain terminals of the respective adjacent field-effect transistors FET11 to FET14 are connected to one another in series. Gate terminals of the respective field-effect transistors FET11 to FET14 are connected to a control voltage terminal Vcnt11 via resistors Rt11 to Rt14, respectively. The drain terminals of the respective field-effect transistors FET11 to FET14 are connected to a voltage fixing terminal Vst11 via resistors Rt15 to Rt18, respectively.

The shunt circuit unit SH11 includes, as with the transfer circuit unit TF11, field-effect transistors FET15 to FET18. Source terminals and drain terminals of the respective adjacent field-effect transistors FET15 to FET18 are connected to one another in series. Gate terminals of the respective field-effect transistors FET15 to FET18 are connected to a control voltage terminal Vcnt12 via resistors Rs11 to Rs14, respectively. The drain terminals of the respective field-effect transistors FET15 to FET18 and the source terminal of the field-effect transistor FET 18 are connected to the voltage fixing terminal Vst11 via resistors Rs15 to Rs19, respectively. The source terminal of the field-effect transistor FET 18 is connected to an electromagnetic wave absorption material element RA11.

To the voltage fixing terminal Vst11 is applied a voltage for stabilizing the potentials at the drain and source terminals of the respective field-effect transistors FET11 to FET18.

The drain terminal of the field-effect transistor FET14 in the transfer circuit unit TF11 is connected to a signal input terminal IN11. The source terminal of the field-effect transistor FET11 in the transfer circuit unit TF11 and the drain terminal of the field-effect transistor FET15 in the shunt circuit unit SH11 are connected to a signal output terminal OUT11. The signal input terminal IN11 and the signal output terminal OUT11 are respectively connected, via capacitors C10 and C11, to the antenna ANT and the receiving circuit unit RX as external components.

In such a configuration, when a voltage of 3 volts is applied to the voltage fixing terminal Vst11 and a high level voltage of 3 volts and a low level voltage of 0 volt are applied, as control voltages, to the control voltage terminals Vcnt11 and Vcnt12, respectively, a forward bias is applied between the gate and source (drain) of each of the field-effect transistors FET11 to FET14 that compose the transfer circuit unit TF11; thus, the field-effect transistors FET11 to FET14 go into an on state. Meanwhile, a reverse bias is applied between the gate and source (drain) of each of the field-effect transistors FET15 to FET18 that compose the shunt circuit unit SH11; thus, the field-effect transistors FET15 to FET18 go into an off state.

In contrast, when control voltages of 0 volt and 3 volts are applied to the control voltage terminals Vcnt11 and Vcnt12, respectively, the field-effect transistors FET11 to FET14 that compose the transfer circuit unit TF11 go into an off state and the field-effect transistors FET15 to FET18 that compose the shunt circuit unit SH11 go into an on state.

When the field-effect transistors FET11 to FET14 that compose the transfer circuit unit TF11 are in an on state, the field-effect transistors FET15 to FET18 that compose the shunt circuit unit SH11 are in an off state. Thus, a signal coming from the antenna ANT passes through the transfer circuit unit TF11 and then is transferred to the receiving circuit unit RX. At this time, since the field-effect transistors FET15 to FET18 in the shunt circuit unit SH11 are in the off state, the shunt circuit unit SH11 does not transfer the signal.

In contrast, when the field-effect transistors FET11 to FET14 in the transfer circuit unit TF11 are in an off state, the signal cannot pass through the transfer circuit unit TF11. Even when a large signal is inputted from the antenna ANT and the signal has leaked through the transfer circuit unit TF11 being in the off state, since the shunt circuit unit SH11 is in an on state, the leaked signal is absorbed by the electromagnetic wave absorption material element RA11. Accordingly, the signal is not transferred to the receiving circuit unit RX.

As described above, by the control voltage terminals Vcnt11 and Vcnt12, the SPST switching apparatus can function as a reception switching apparatus.

The SPDT high-frequency switching apparatus shown in FIG. 1 is configured such that two SPST switching apparatuses shown in FIG. 4 are provided and the signal input terminal IN11 is shared between the SPST switching apparatuses, i.e., the SPST switching apparatuses are connected in parallel to the signal input terminal IN11.

In the high-frequency switching apparatus according to the first embodiment, by providing the electromagnetic wave absorption material elements RA11 and RA12 to ends of the respective shunt circuit units SH11 and SH12, respectively, 35 decibels are obtained as the isolation characteristics of an off path and thus better characteristics can be implemented as compared with conventional art high-frequency switching apparatuses.

In addition, the electrostatic surge breakdown voltage of a high-frequency switching apparatus in which a MIM capacitor is used, as a DC cut capacitor, in a shunt circuit unit is dependent on the breakdown voltage of the MIM capacitor and thus is very weak; however, as in the present embodiment, in the configuration using electromagnetic wave absorption material elements, the electrostatic surge breakdown voltage of a high-frequency switching apparatus can be improved to the electrostatic surge breakdown voltage level of field-effect transistors. Accordingly, the ESD breakdown voltage of the high-frequency switching apparatus can be improved about ten times.

Furthermore, since the shunt circuit units SH11 and SH12 do not need to be connected to ground GND, wire pads used to establish a connection to the ground GND can be reduced in number, making it possible to reduce the chip area. This also makes it possible to reduce the package size.

As such, according to the high-frequency switching apparatus according to the first embodiment, a small-sized high-frequency switching apparatus can be implemented which is excellent in isolation characteristics, which does not break down even when a signal of a high voltage, such as an electrostatic surge, flows into the apparatus, and which functions as a high-frequency switching apparatus.

Figure 5A:
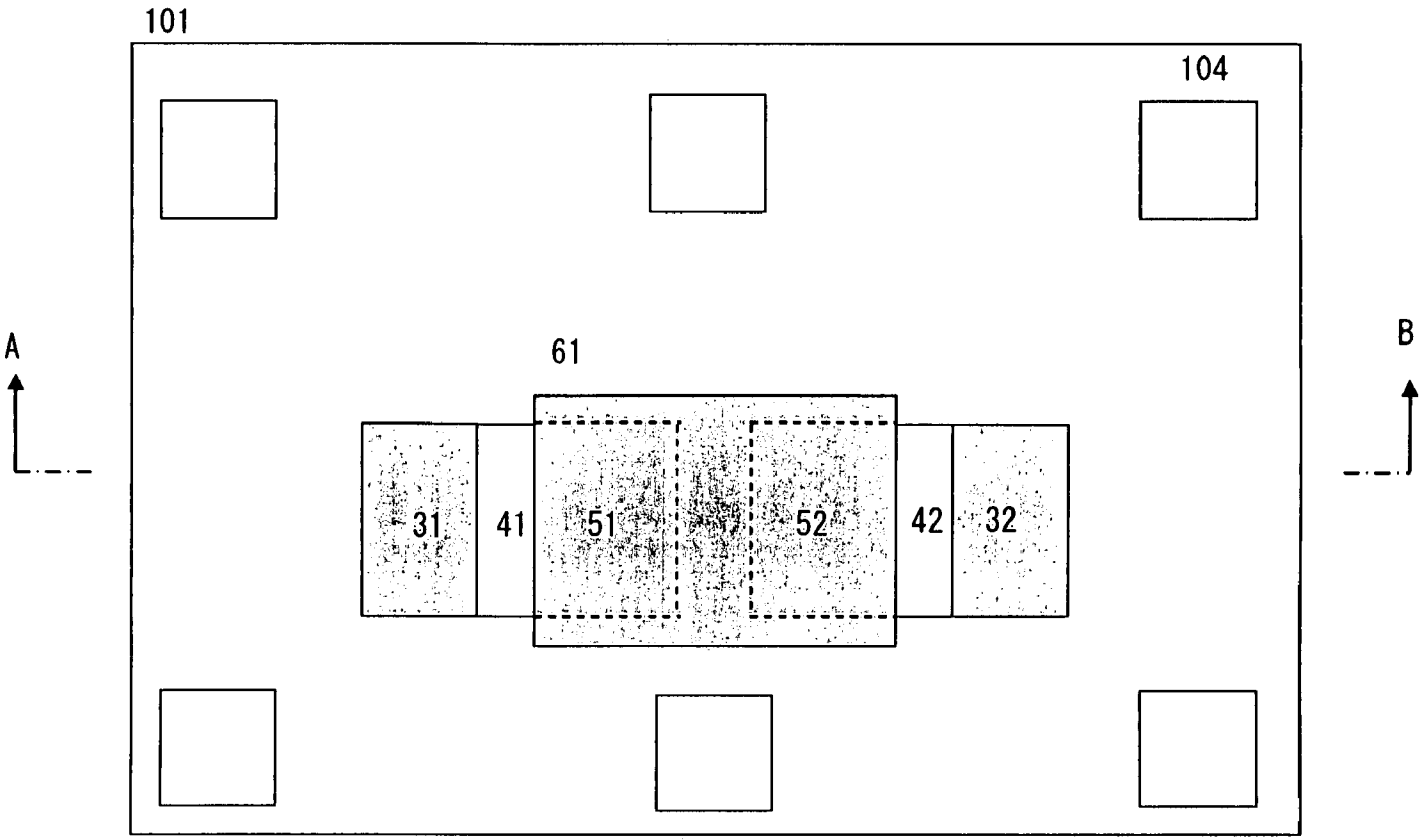
FIGS. 5A and 5B are a top view and a cross-sectional view, respectively, of a semiconductor chip that composes a SPDT high-frequency switching apparatus having another configuration, according to the first embodiment of the present invention.
Figure 5B:
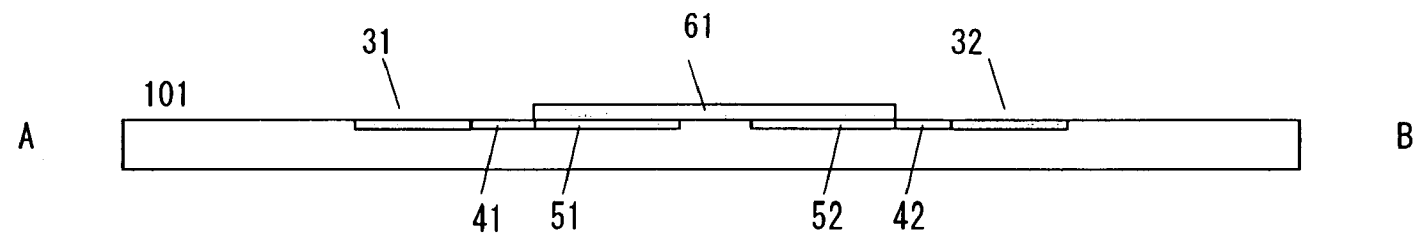

FIG. 5A is a top view of a semiconductor chip 101 composing a SPDT high-frequency switching apparatus in which an electromagnetic wave absorption material element is provided for shared use. FIG. 5B is a cross-sectional view taken along a line A-B of the semiconductor chip 101. As shown in FIGS. 5A and 5B, by providing an electromagnetic wave absorption material element for shared use, the area can be reduced and not only a reduction in package size but also a reduction in the cost of the high-frequency switching apparatus according to the first embodiment are achieved.

Needless to say, although, in the first embodiment, field-effect transistors that compose a high-frequency switching apparatus are depression-type field-effect transistors using a GaAs semiconductor chip and transfer circuit units and shunt circuit units each include field-effect transistors of four stages in series, the same advantageous effects can also be obtained by other configurations. Not only in a SPDT high-frequency switching apparatus but also in high-frequency switching apparatuses of other configurations having shunt circuits, the same advantageous effects can be obtained. The number of stages of field-effect transistors connected to one another in series is not limited to four. That is, a single stage or a plurality of stages, two or more stages, may also be used. The number of stages is appropriately set to one or more based on the amplitude of a signal to be switched in a high-frequency switching apparatus and the breakdown voltage of field-effect transistors.

Although, in the first embodiment, as an electromagnetic wave absorption material element, a ferrite-based material film with a thickness of 10 micrometers that is deposited on an electrode by an ECR sputtering technique is used, the same advantageous effects can be obtained regardless of the type and film thickness of and a deposition method for an electromagnetic wave absorption material. By the film thickness the attenuation band can be adjusted, and by increasing the area the isolation characteristics can be improved. For the electromagnetic wave absorption material element, even by affixing an electromagnetic wave absorption material element formed by other processes than a semiconductor process onto an electrode to which a shunt circuit unit is connected, the same advantageous effects are obtained.

Figure 6A:
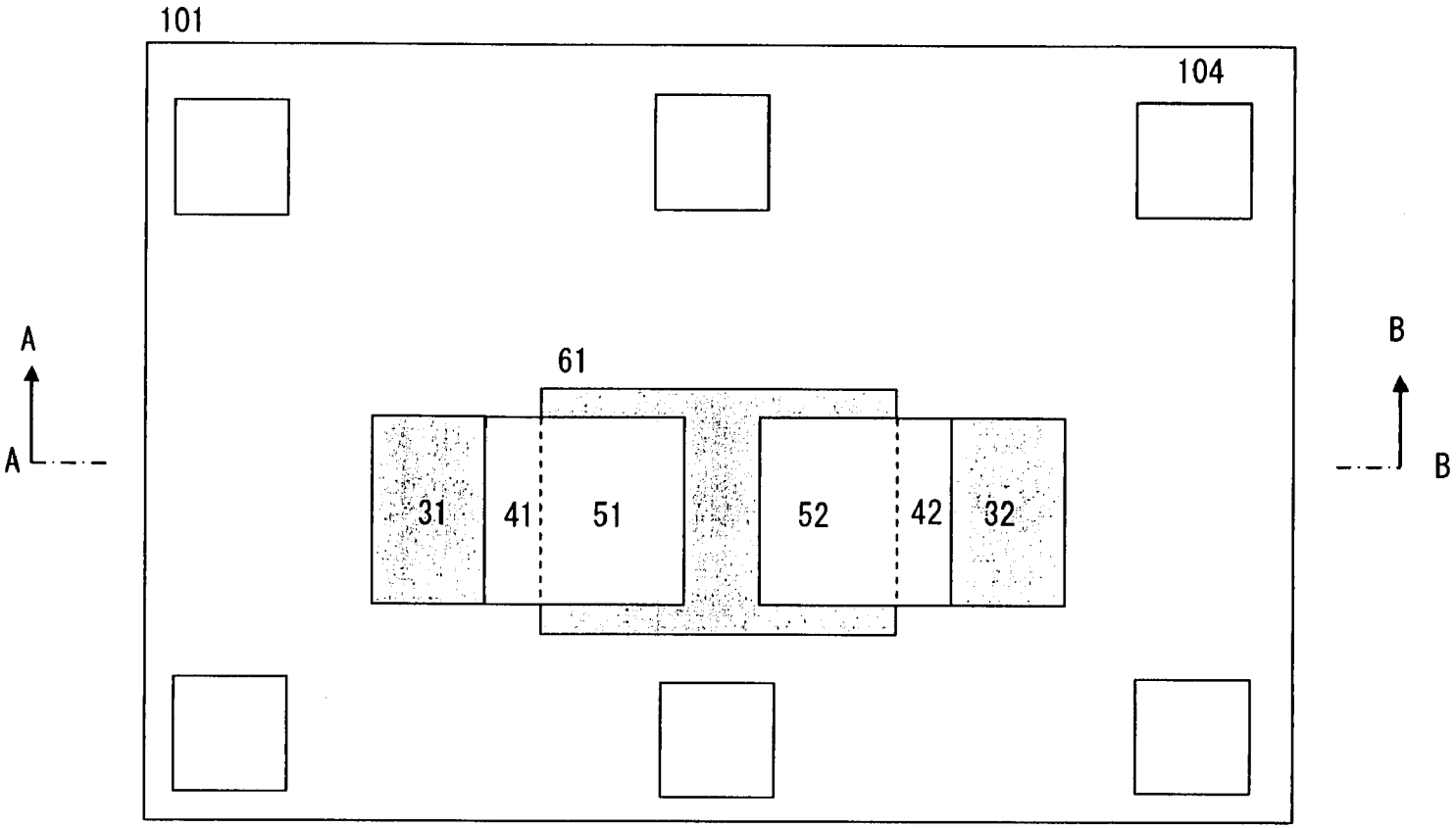
FIGS. 6A and 6B are a top view and a cross-sectional view, respectively, of a semiconductor chip that composes a SPDT high-frequency switching apparatus having still another configuration, according to the first embodiment of the present invention.
Figure 6B:
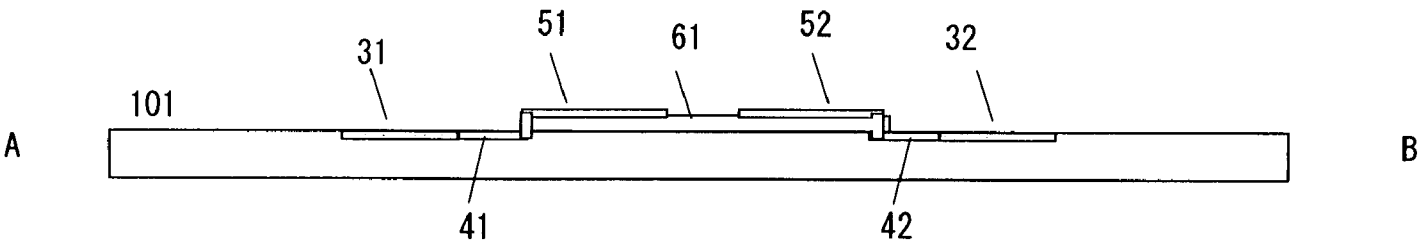

FIG. 6A is a top view of a semiconductor chip 101 included in a SPDT high-frequency switching apparatus which is one of high-frequency switching apparatuses according to the first embodiment. The semiconductor chip 101 has an electromagnetic wave absorption material element 61 formed thereon, and electrodes 51 and 52 disposed on the electromagnetic wave absorption material element 61 and electrically connected to shunt circuits. FIG. 6B is a cross-sectional view taken along a line A-B of the semiconductor chip 101.

As shown in FIGS. 6A and 6B, even by disposing the electrodes 51 and 52 on the formed electromagnetic wave absorption material element 61, the same advantageous effects as those described above can be obtained.

Second Embodiment

A SPDT high-frequency switching apparatus which is one of high-frequency switching apparatuses according to a second embodiment will be described with reference to the drawings.

Figure 7:
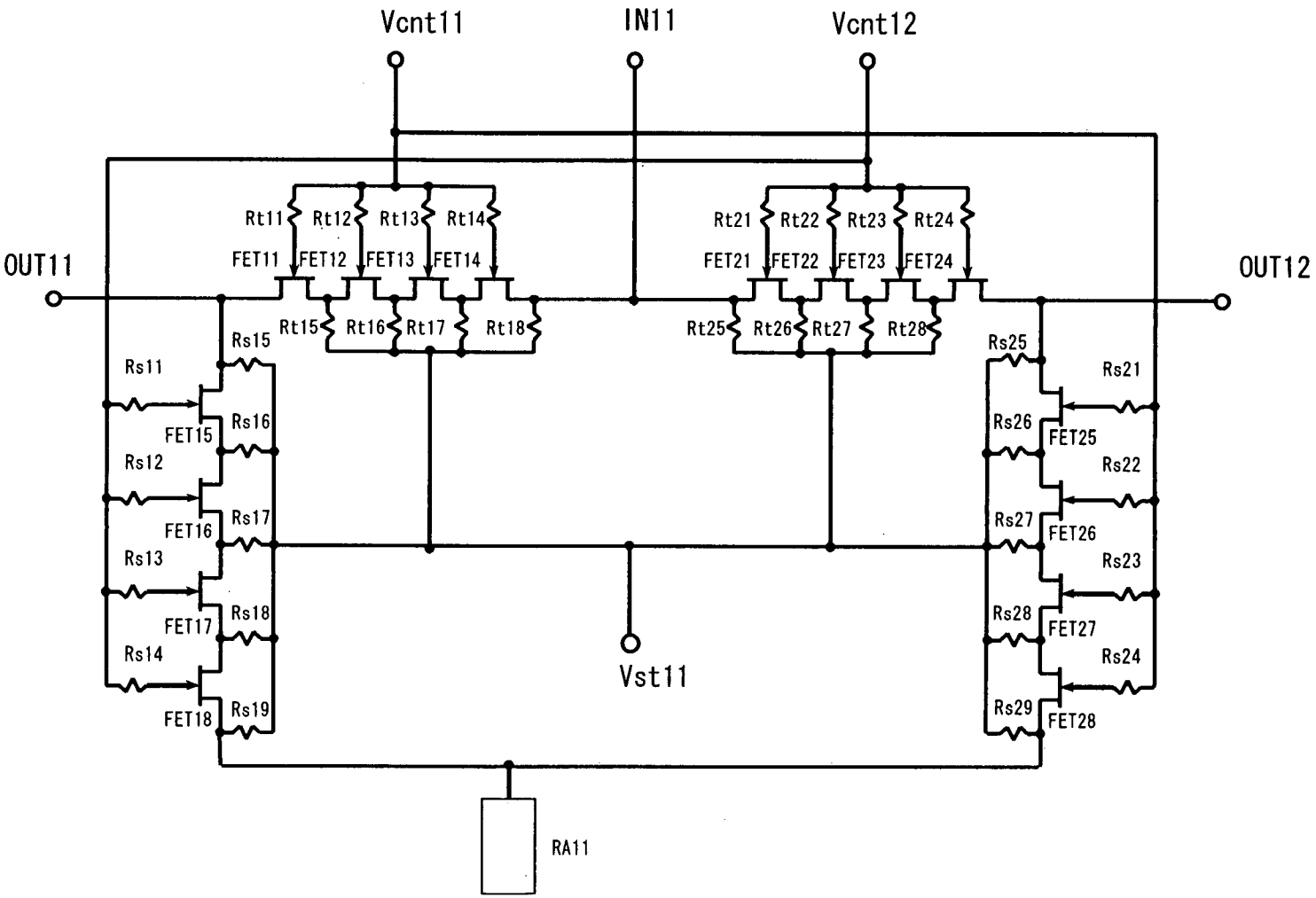
FIG. 7 is a circuit diagram showing an equivalent circuit of a SPDT high-frequency switching apparatus according to a second embodiment of the present invention.
Figure 8:
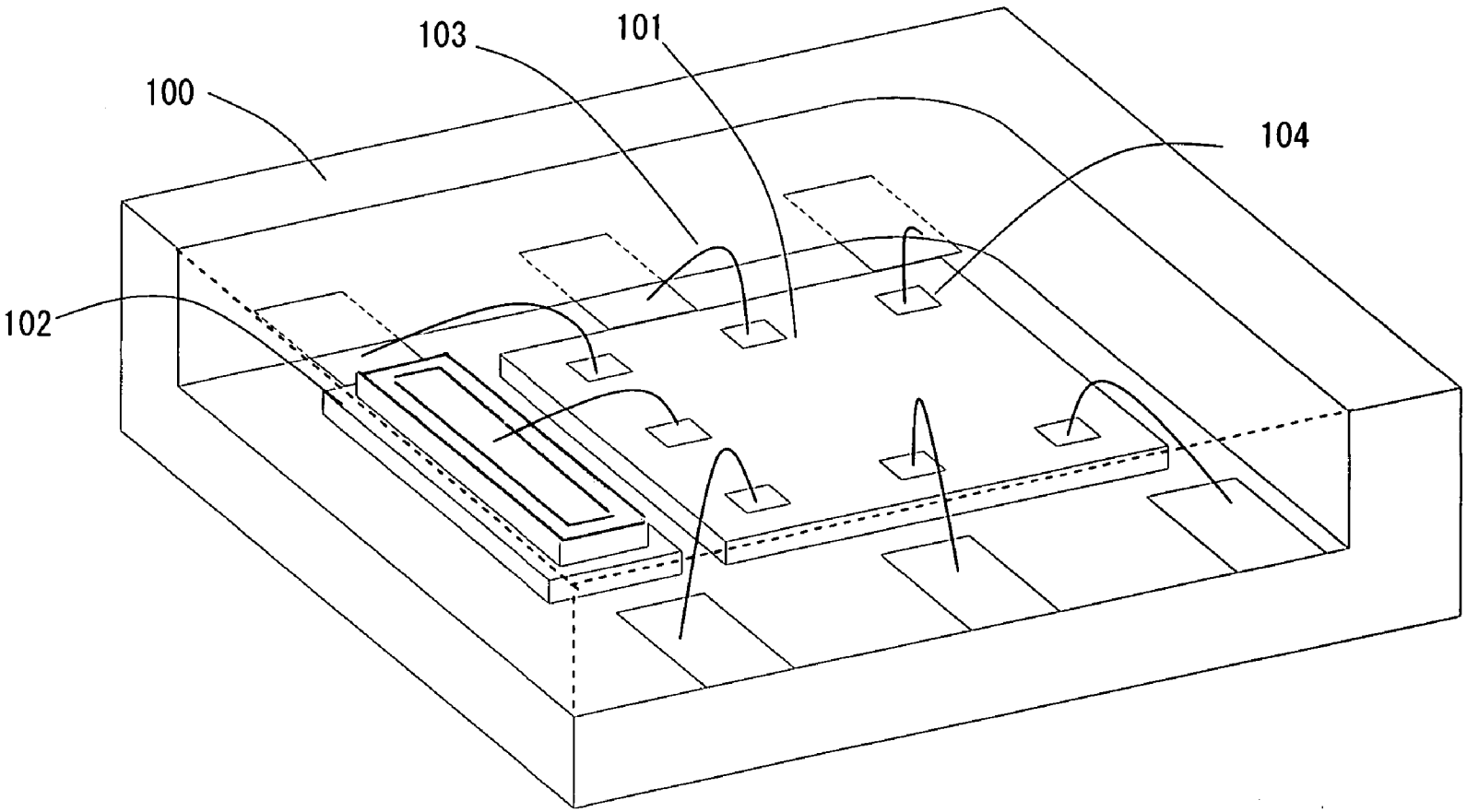
FIG. 8 is a perspective view showing the inside of a package of the SPDT high-frequency switching apparatus according to the second embodiment of the present invention.
Figure 9:
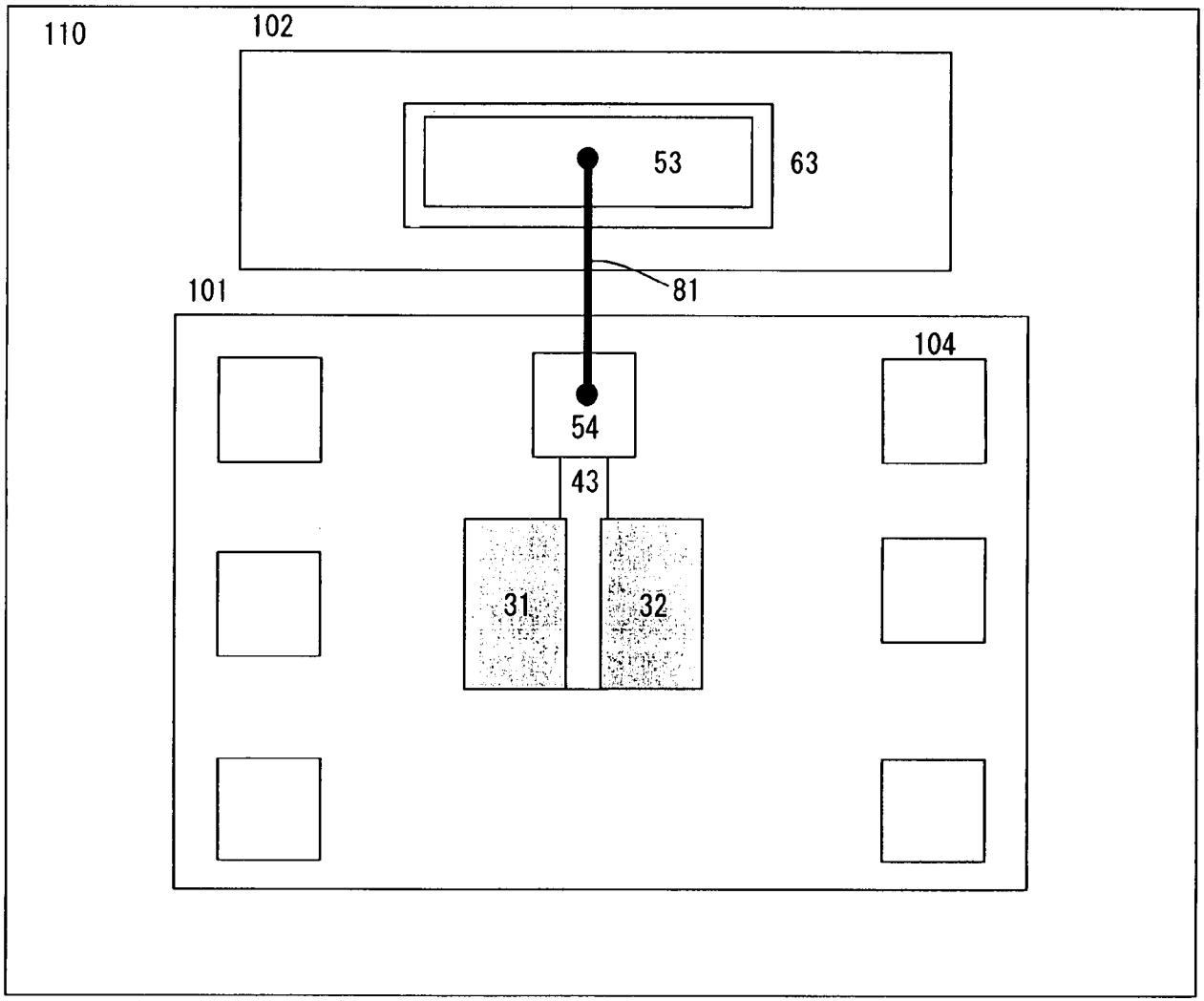
FIG. 9 is a top view of a semiconductor mounting surface that composes the SPDT high-frequency switching apparatus according to the second embodiment of the present invention.

FIG. 7 is an equivalent circuit diagram of the SPDT high-frequency switching apparatus according to the second embodiment. FIG. 8 is a perspective view of the SPDT high-frequency switching apparatus according to the second embodiment. FIG. 9 is a top view of a semiconductor chip mounting surface that composes the SPDT high-frequency switching apparatus according to the second embodiment.

In FIG. 7, reference numerals FET11 to FET18 and FET21 to FET 28 each denote a depression-type field-effect transistor (hereinafter, referred to as a "field-effect transistor"). Reference numerals Rt11 to Rt18, Rt21 to Rt28, Rs11 to Rs19, and Rs21 to Rs29 each denote a resistor. Reference numeral IN11 denotes a signal input terminal. Reference numerals OUT11 and OUT12 denote a first and a second signal output terminals, respectively. Reference numerals Vcnt11 and Vcnt12 denote a first and a second control voltage terminals, respectively. Reference numeral Vst11 denotes a voltage fixing terminal. Reference numeral RA11 denotes an electromagnetic wave absorption material element.

In FIG. 8, reference numeral 100 denotes a package of the high-frequency switching apparatus. Reference numeral 101 denotes a semiconductor chip having the SPDT high-frequency switching apparatus, excluding the electromagnetic wave absorption material element, formed on a semiconductor substrate. Reference numeral 102 denotes a semiconductor chip having the electromagnetic wave absorption material element formed on a semiconductor substrate.

In FIG. 9, reference numerals 101 and 102 each denote a semiconductor chip. Reference numerals 31 and 32 each denote a shunt circuit unit formed on the semiconductor chip 101. Reference numeral 43 denotes electrical wiring formed on the semiconductor chip 101. Reference numerals 53 and 54 denote electrodes formed on the semiconductor chips 102 and 101, respectively. Reference numeral 63 denotes an electromagnetic wave absorption material element formed on the semiconductor chip 102. Reference numeral 81 denotes a wire that connects between the electrodes 53 and 54.

As shown in FIG. 9, the shunt circuit units 31 and 32 formed on the semiconductor chip 101 are electrically connected, by the electrical wiring 43, to the electrode 54 which is a connection terminal. The electrode 54 is electrically connected, by the wire 81 of gold, for example, to the electrode 53 which is a connection terminal of the electromagnetic wave absorption material element 63 formed on the semiconductor chip 102.

As shown in FIGS. 8 and 9, by excluding the electromagnetic wave absorption material element 63 from the semiconductor chip 101 that uses GaAs as a main material, the chip area of the semiconductor chip 101 can be reduced. Since the unit price of semiconductor chips that use GaAs as a main material is generally higher than that of the semiconductor chip 102 that uses Si as a main material, a high-frequency switching apparatus can be implemented at a lower cost than one in which an electromagnetic wave absorption material element is formed on the semiconductor chip 101 that uses GaAs as the main material.

As shown in FIGS. 7 and 9, by using the electromagnetic wave absorption material element 63 as an element shared between ends of the respective shunt circuit units 31 and 32, not only the number of elements but also the number of wire connected electrodes used to connect the semiconductor chip 101 to the electromagnetic wave absorption material element 63 can be reduced. Accordingly, miniaturization of the semiconductor chips 101 and 102 and the package 100 and a reduction in cost are achieved.

As such, according to the high-frequency switching apparatus according to the second embodiment, the same advantageous effects as those obtained by the high-frequency switching apparatuses according to the first embodiment are obtained and a high-frequency switching apparatus with excellent isolation characteristics can be provided at a low cost.

A wire that connects the semiconductor chip 101 to the semiconductor chip 102 has an inductance component and thus an increase in inductance component results in a deterioration of high-frequency characteristics. Hence, by connecting a plurality of wires in parallel, the inductance component is suppressed, making it possible to prevent a deterioration of high-frequency characteristics.

Although the high-frequency switching apparatus according to the second embodiment uses the electromagnetic wave absorption material element 63 formed on the semiconductor chip 102, an electromagnetic wave absorption material element does not need to be mounted on a semiconductor chip; even by using a mounting component having mounted thereon an electromagnetic wave absorption material element, the same advantageous effects can be obtained.

Needless to say, even when the configuration of the high-frequency switching apparatus according to the second embodiment is other than that of a SPDT high-frequency switching apparatus using a semiconductor chip that uses GaAs as a main material, in a high-frequency switching apparatus having shunt circuits, the same advantageous effects can be obtained.

Third Embodiment

A SPDT high-frequency switching apparatus which is one of high-frequency switching apparatuses according to a third embodiment will be described with reference to the drawings.

An equivalent circuit diagram of the SPDT high-frequency switching apparatus according to the third embodiment is the same as that (FIG. 7) of the SPDT high-frequency switching apparatus according to the second embodiment and thus the description thereof will be omitted.

Figure 10:
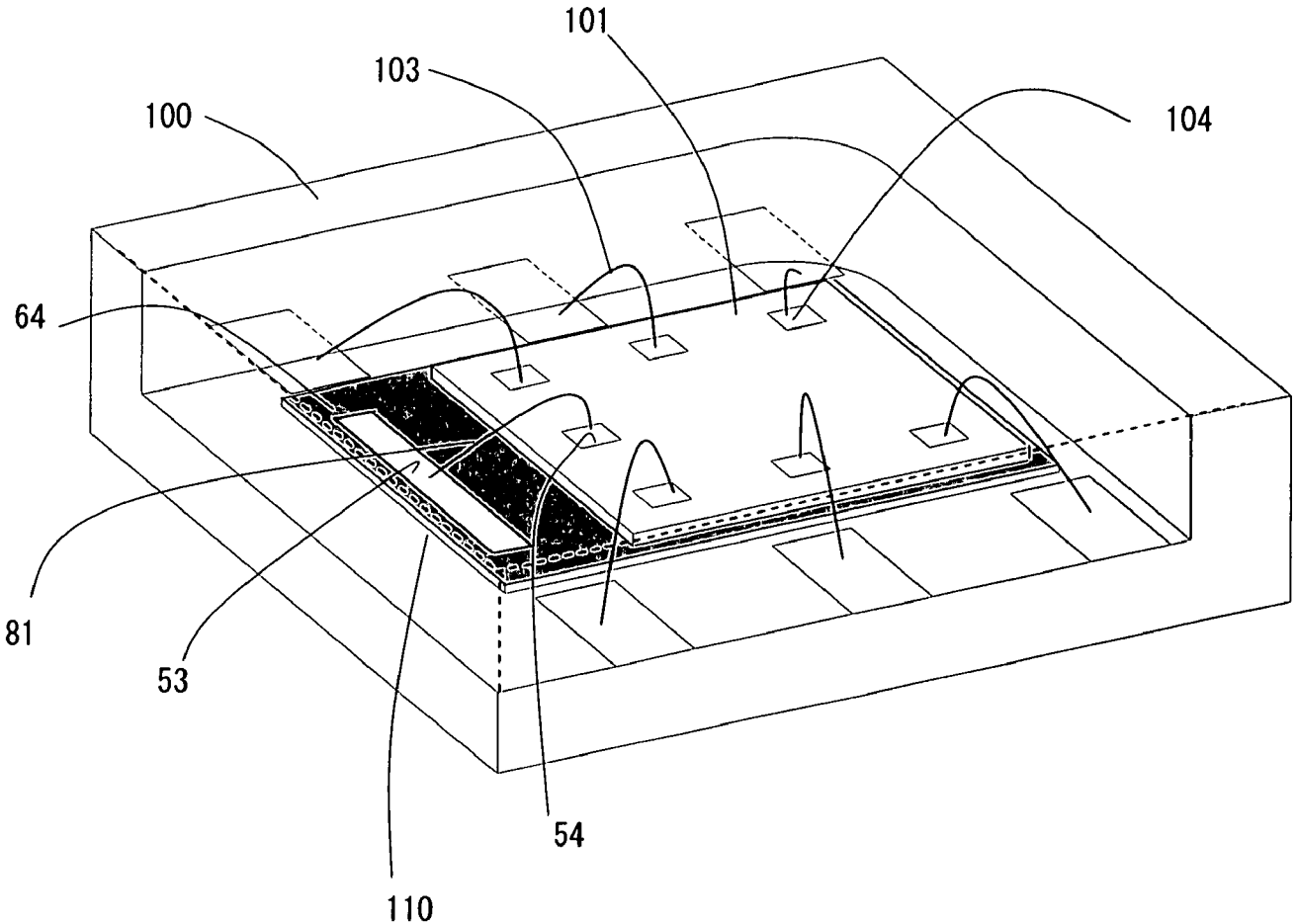
FIG. 10 is a perspective view showing the inside of a package of a SPDT high-frequency switching apparatus according to a third embodiment of the present invention.
Figure 11:
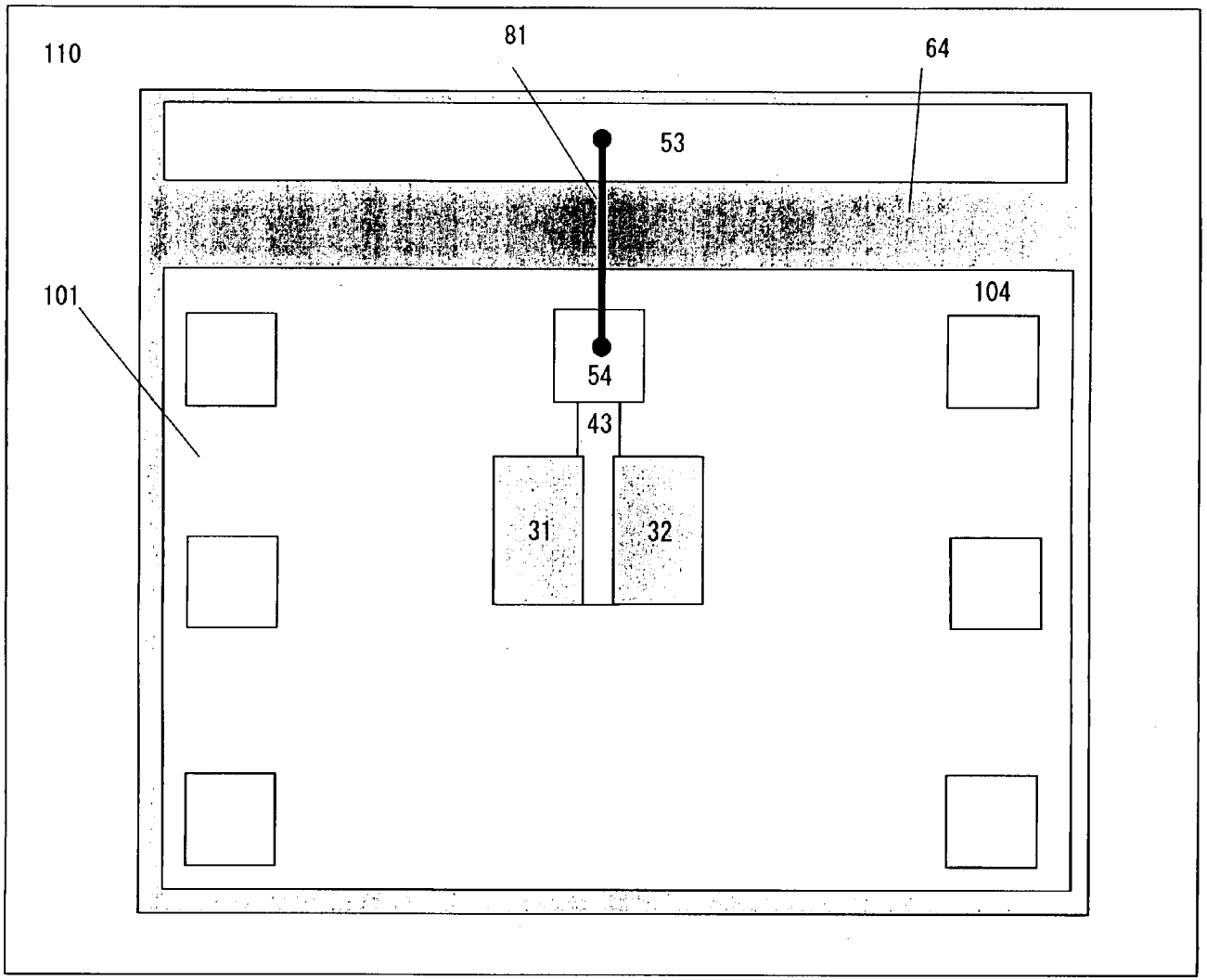
FIG. 11 is a top view of a semiconductor mounting surface that composes the SPDT high-frequency switching apparatus according to the third embodiment of the present invention.

FIG. 10 is a perspective view of a package of the SPDT high-frequency switching apparatus according to the third embodiment. FIG. 11 is a top view of a semiconductor chip mounting surface that composes the SPDT high-frequency switching apparatus according to the third embodiment. In FIG. 10, reference numeral 100 denotes a package of the high-frequency switching apparatus. Reference numeral 101 denotes a semiconductor chip. Reference numeral 110 denotes a mounting substrate. Reference numeral 64 denotes an electromagnetic wave absorption material element formed on the mounting substrate 110. In FIG. 11, reference numeral 101 denotes a semiconductor chip. Reference numerals 31 and 32 each denote a shunt circuit unit formed on the semiconductor chip 101. Reference numeral 43 denotes electrical wiring formed on the semiconductor chip 101. Reference numeral 53 denotes an electrode formed on the electromagnetic wave absorption material element 64. Reference numeral 54 denotes an electrode formed on the semiconductor chip 101. Reference numeral 64 denotes an electromagnetic wave absorption material element. Reference numeral 81 denotes a wire that connects the electrode 53 to the electrode 54.

In the SPDT high-frequency switching apparatus according to the third embodiment, the semiconductor chip 101 that uses GaAs as a main material is mounted on the electromagnetic wave absorption material element 64 formed on the mounting substrate 110 included in the package 100. The shunt circuit units 31 and 32 formed on the semiconductor chip 101 are electrically connected, by the electrical wiring 43, to the electrode 54 which is a connection terminal. The electrode 54 is electrically connected, by the wire 81 of gold, for example, to the electrode 53 formed on the electromagnetic wave absorption material element 64 and being a connection terminal.

By the film thickness and area of the electromagnetic wave absorption material element 64, the electromagnetic wave absorption characteristics can be changed; the larger the area, the better the absorption characteristics. Thus, in the SPDT high-frequency switching apparatus according to the third embodiment, regardless of the area of a semiconductor chip or mounting components, the area of an electromagnetic wave absorption material element can also be changed according to the area of a semiconductor mounting substrate included in a semiconductor package. By using the electromagnetic wave absorption material element 64 with a large area, the isolation characteristics can be further improved.

As such, according to the high-frequency switching apparatus according to the third embodiment, the same advantageous effects as those obtained by the high-frequency switching apparatuses according to the first embodiment are obtained and a high-frequency switching apparatus with better isolation characteristics can be provided.

Figure 12A:
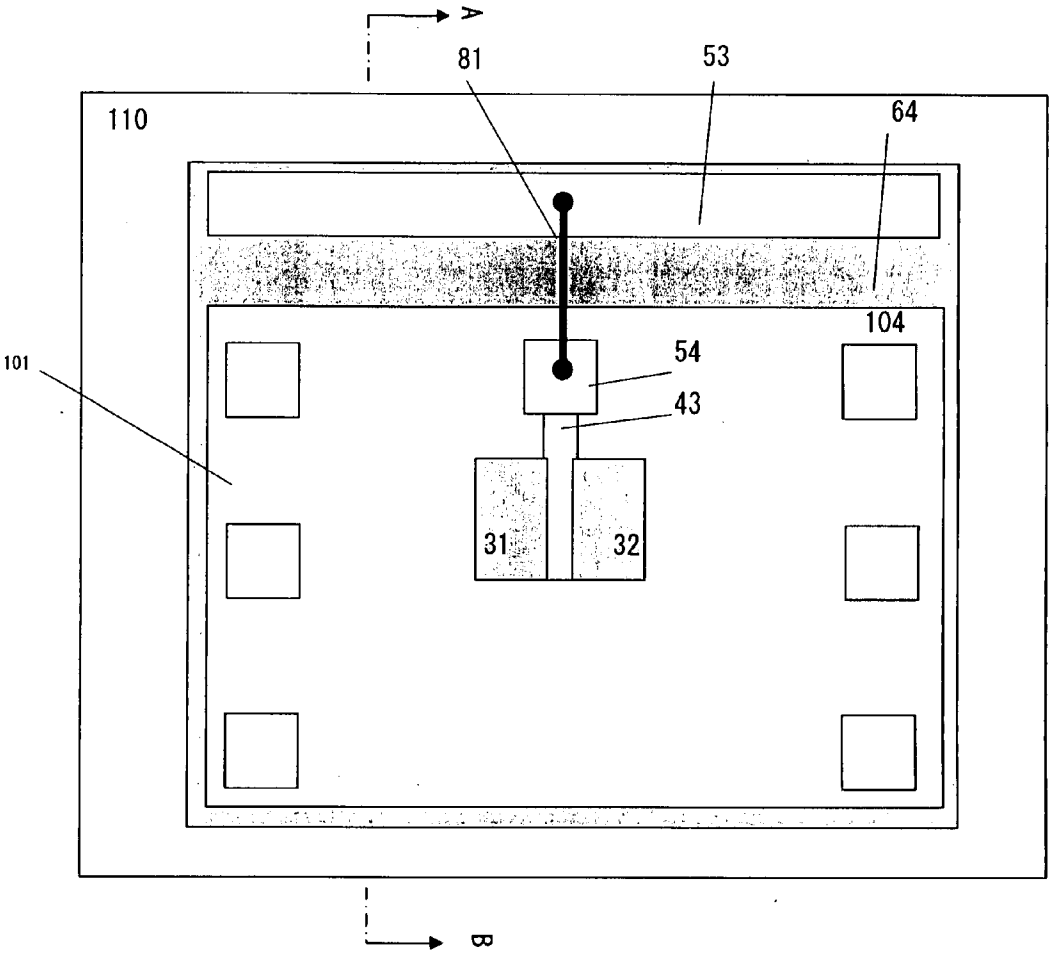
FIGS. 12A and 12B are a top view and a cross-sectional view, respectively, of a semiconductor mounting surface that composes a SPDT high-frequency switching apparatus having another configuration, according to the third embodiment of the present invention.
Figure 12B:
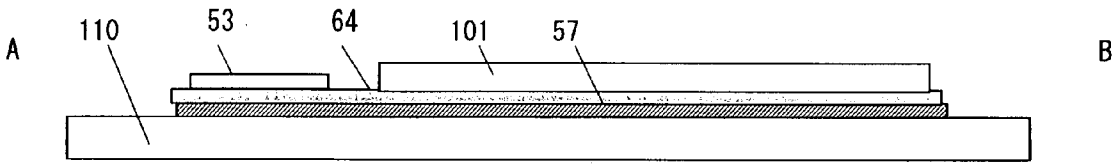

FIG. 12A is a top view of a mounting surface of a SPDT high-frequency switching apparatus having another configuration, according to the third embodiment. FIG. 12B is a cross-sectional view taken along a line A-B of the SPDT high-frequency switching apparatus. In FIGS. 12A and 12B, reference numeral 101 denotes a semiconductor chip. Reference numeral 110 denotes a mounting substrate. Reference numeral 57 denotes an electrode formed on the mounting substrate 110 and connected to ground GND. Reference numeral 64 denotes an electromagnetic wave absorption material element formed on the electrode 57. Reference numerals 31 and 32 each denote a shunt circuit unit formed on the semiconductor chip 101. Reference numeral 43 denotes electrical wiring formed on the semiconductor chip 101. Reference numeral 53 denotes an electrode formed on the electromagnetic wave absorption material element 64. Reference numeral 54 denotes an electrode formed on the semiconductor chip 101. Reference numeral 81 denotes a wire that connects the electrode 53 to the electrode 54. The semiconductor chip 101 is mounted on the electromagnetic wave absorption material element 64.

In the SPDT high-frequency switching apparatus shown in FIGS. 12A and 12B, the electrode 57 is formed on the mounting substrate 110, the electrode 57 is electrically connected to the ground GND, the electromagnetic wave absorption material element 64 is formed on the electrode 57, and the electrode 53 is formed on the electromagnetic wave absorption material element 64. According to this, by sandwiching the electromagnetic wave absorption material element 64 between the electrodes 57 and 53 and thereby forming a capacitor structure, the electric field concentration to the electromagnetic wave absorption material element 64 is promoted and thus a leaked signal can be more absorbed by the electromagnetic wave absorption material element 64. Accordingly, the isolation characteristics can be improved.

Figure 13A:
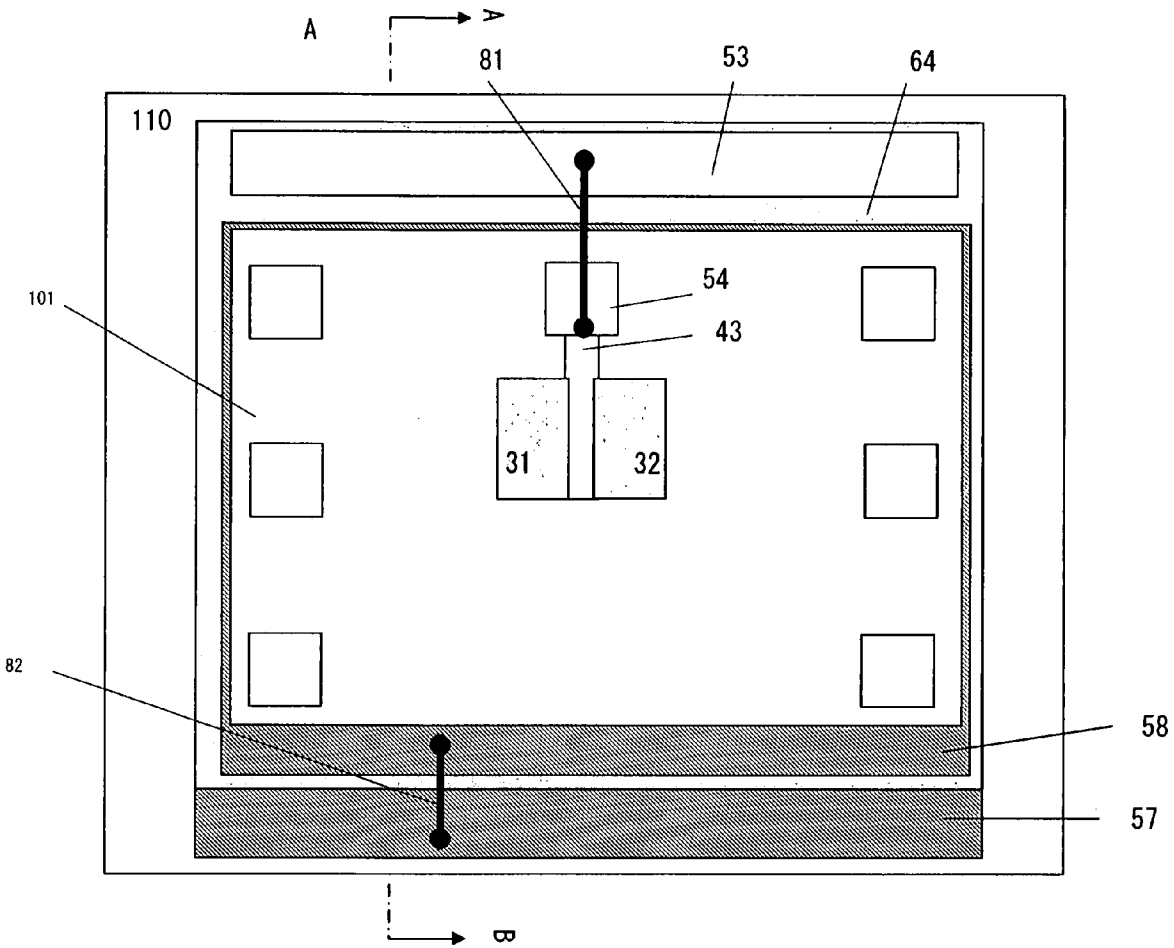
FIGS. 13A and 13B are a top view and a cross-sectional view, respectively, of a semiconductor mounting surface that composes a SPDT high-frequency switching apparatus having still another configuration, according to the third embodiment of the present invention.
Figure 13B:
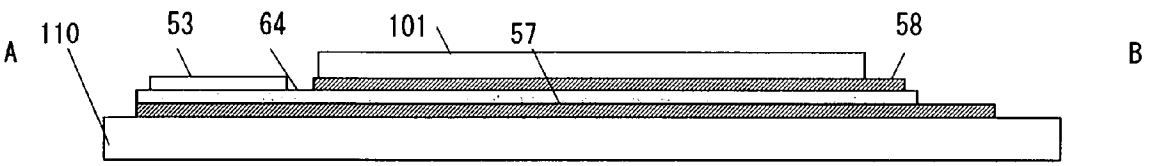

As shown in FIGS. 13A and 13B, it is also possible to form a configuration in which an electrode 58 having a larger area than a semiconductor chip 101 and electrically connected to ground GND is formed on an electromagnetic wave absorption material element 64 so as to be electrically insulated from an electrode 53 and the semiconductor chip 101 is mounted on the electrode 58. By this configuration, the potential at the substrate of the semiconductor chip 101 can be stabilized and thus a high-frequency switching apparatus with better high-frequency characteristics can be implemented. Reference numeral 82 denotes a wire that connects between the electrodes 57 and 58.

Needless to say, even when the configuration of the high-frequency switching apparatus according to the third embodiment is other than that of a SPDT high-frequency switching apparatus using a semiconductor chip that uses GaAs as a main material, in a high-frequency switching apparatus having shunt circuits, the same advantageous effects can be obtained.

By forming the electromagnetic wave absorption material element 64 not on a mounting substrate but on a functional element, such as a semiconductor chip which is different from the semiconductor chip 101, further mounting thereon the semiconductor chip 101, and electrically connecting, as with the above, the electromagnetic wave absorption material element 64 to shunt circuits formed on the semiconductor chip 101, a high-frequency switching apparatus with high functionality and a small mounting area can also be implemented.

Fourth Embodiment

A SPDT high-frequency switching apparatus which is one of high-frequency switching apparatuses according to a fourth embodiment will be described with reference to the drawings.

Figure 14:
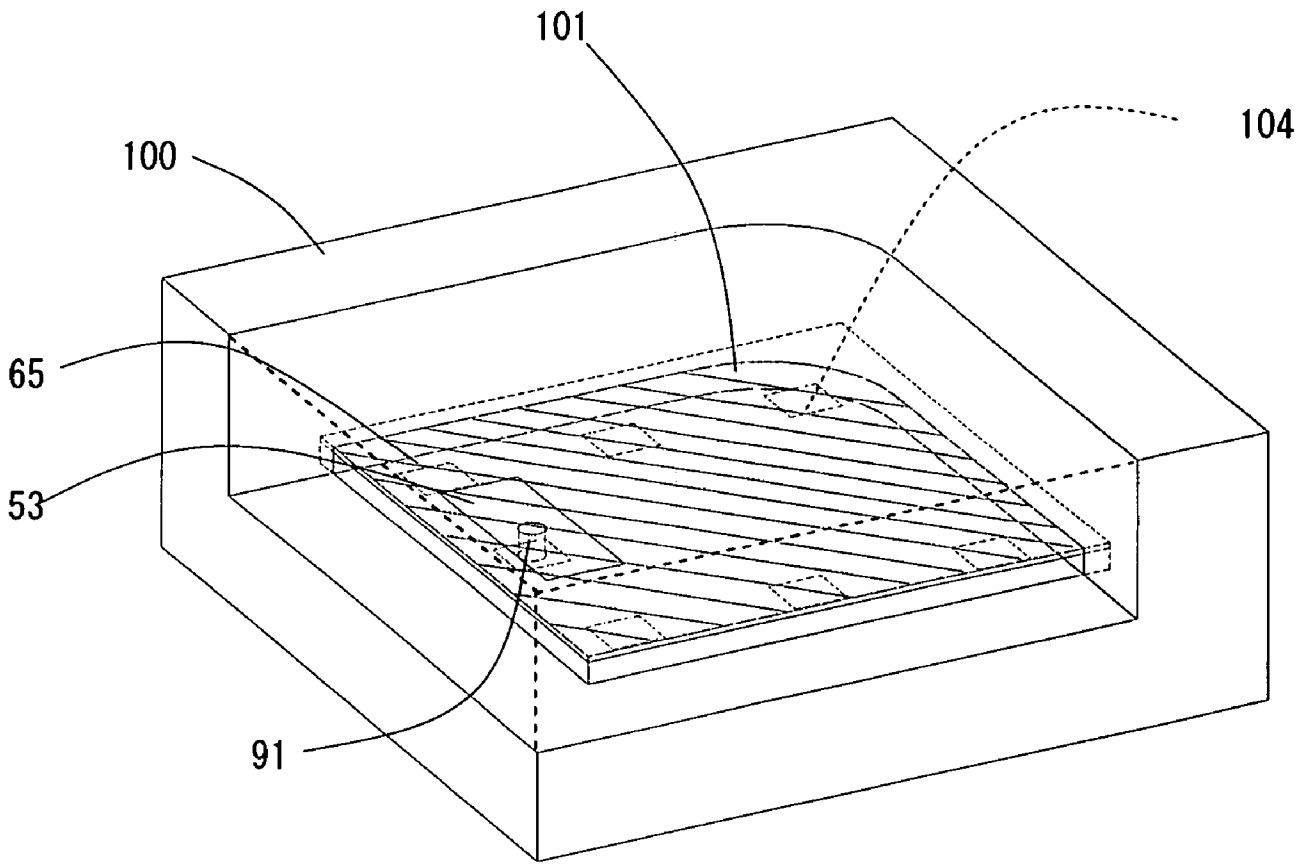
FIG. 14 is a perspective view showing the inside of a package of a SPDT high-frequency switching apparatus according to a fourth embodiment of the present invention.
Figure 15A:
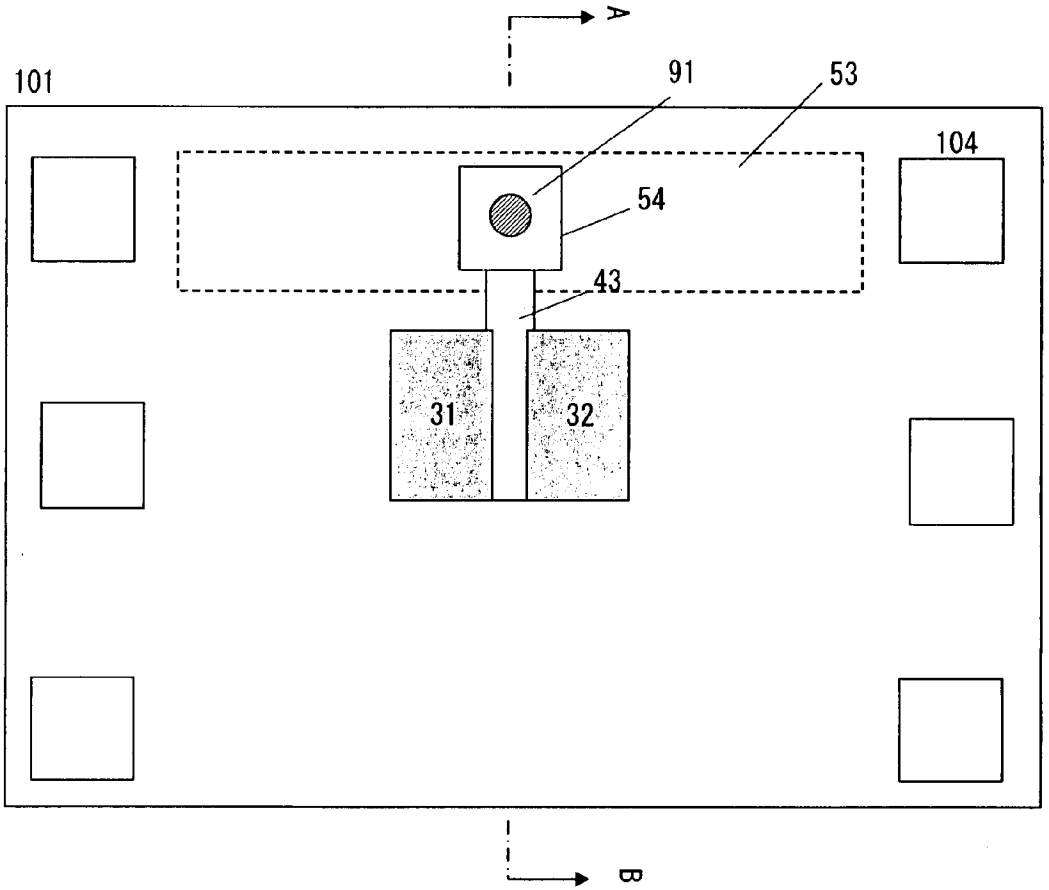
FIGS. 15A and 15B are a top view and a cross-sectional view, respectively, of a semiconductor chip that composes the SPDT high-frequency switching apparatus according to the fourth embodiment of the present invention.
Figure 15B:
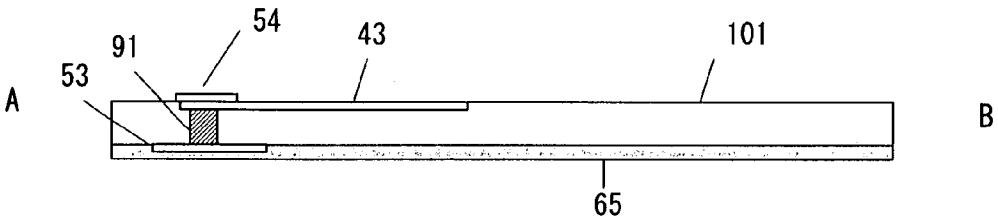

FIG. 14 is a perspective view of a package of the SPDT high-frequency switching apparatus according to the fourth embodiment. FIGS. 15A and 15B are a top perspective view and a cross-sectional view, respectively, of a semiconductor chip that composes the SPDT high-frequency switching apparatus according to the fourth embodiment. In FIG. 14, reference numeral 100 denotes a package of the high-frequency switching apparatus. Reference numeral 101 denotes a semiconductor chip. Reference numeral 65 denotes an electromagnetic wave absorption material element. Reference numeral 53 denotes an electrode. Reference numeral 91 denotes an inner via. In FIGS. 15A and 15B, reference numeral 101 denotes a semiconductor chip. Reference numerals 31 and 32 each denote a shunt circuit unit formed on a surface of the semiconductor chip 101. Reference numeral 43 denotes electrical wiring formed on the surface of the semiconductor chip 101. Reference numeral 53 denotes an electrode formed on a backside of the semiconductor chip 101. Reference numeral 54 denotes an electrode formed on the surface of the semiconductor chip 101. Reference numeral 65 denotes an electromagnetic wave absorption material element formed on the backside of the semiconductor chip 101, which includes the electrode 53. Reference numeral 91 denotes an inner via that connects the electrode 53 to the electrode 54.

As shown in FIG. 14, the semiconductor chip 101 included in the SPDT high-frequency switching apparatus according to the fourth embodiment is mounted in a face-down manner. As shown in FIGS. 15A and 15B, the electrode 53 is formed on the backside of the semiconductor chip 101 included in the SPDT high-frequency switching apparatus according to the fourth embodiment, and the electromagnetic wave absorption material element 65 is further formed thereover so as to cover the entire backside. The shunt circuit units 31 and 32 formed on the semiconductor chip 101 are electrically connected to the electrode 54 by the electrical wiring 43. The electrode 54 is electrically connected, via the inner via 91, to the electrode 53 and the electromagnetic wave absorption material element 65.

In the high-frequency switching apparatus configured in the above-described manner, by forming an electromagnetic wave absorption material element on the entire backside of a chip and flip-chip mounting the chip, the same advantageous effects as those obtained by the high-frequency switching apparatuses according to the first embodiment can be obtained and a package with a small-sized chip is implemented.

As such, according to the high-frequency switching apparatus according to the fourth embodiment, a high-frequency switching apparatus in a small size and with excellent isolation characteristics can be provided.

Needles to say, even when the configuration of the high-frequency switching apparatus according to the fourth embodiment is other than that of a SPDT high-frequency switching apparatus using a semiconductor chip that uses GaAs as a main material, in a high-frequency switching apparatus having shunt circuits, the same advantageous effects can be obtained.

Figure 16A:
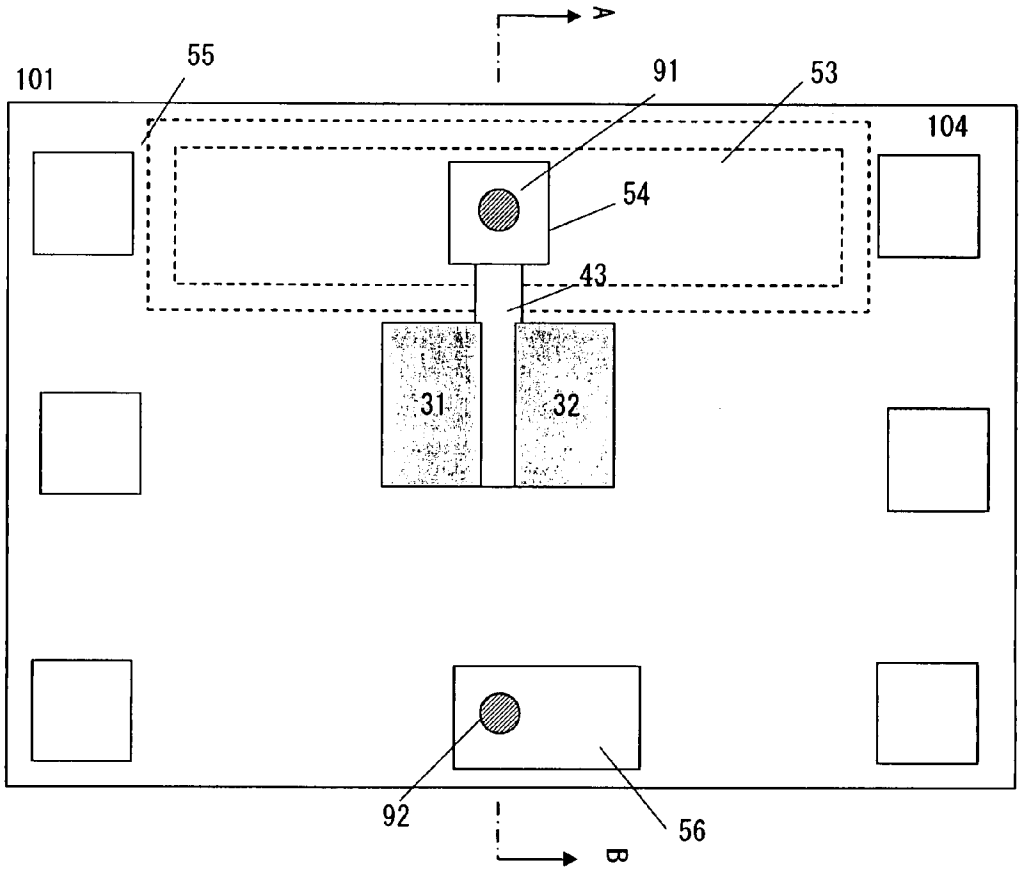
FIGS. 16A and 16B are a top view and a cross-sectional view, respectively, of a semiconductor chip that composes a SPDT high-frequency switching apparatus having another configuration, according to the fourth embodiment of the present invention.
Figure 16B:
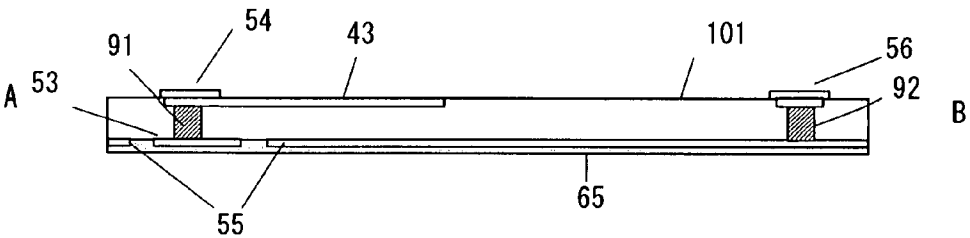
Figure 17:
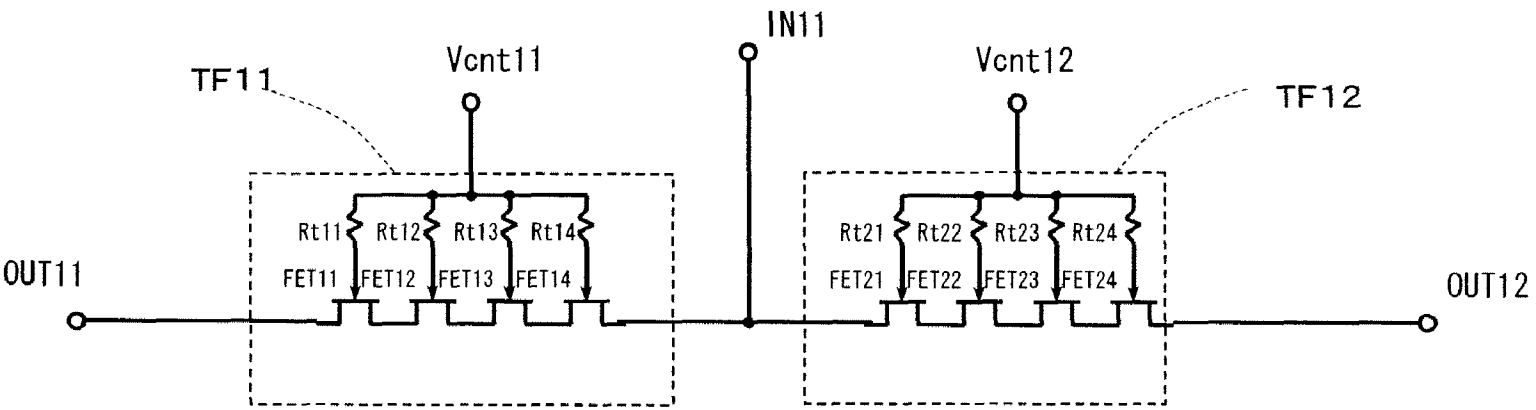
FIG. 17 PRIOR ART
FIG. 17 is a circuit diagram showing an equivalent circuit of a SPDT high-frequency switching apparatus according to conventional art.
Figure 18:
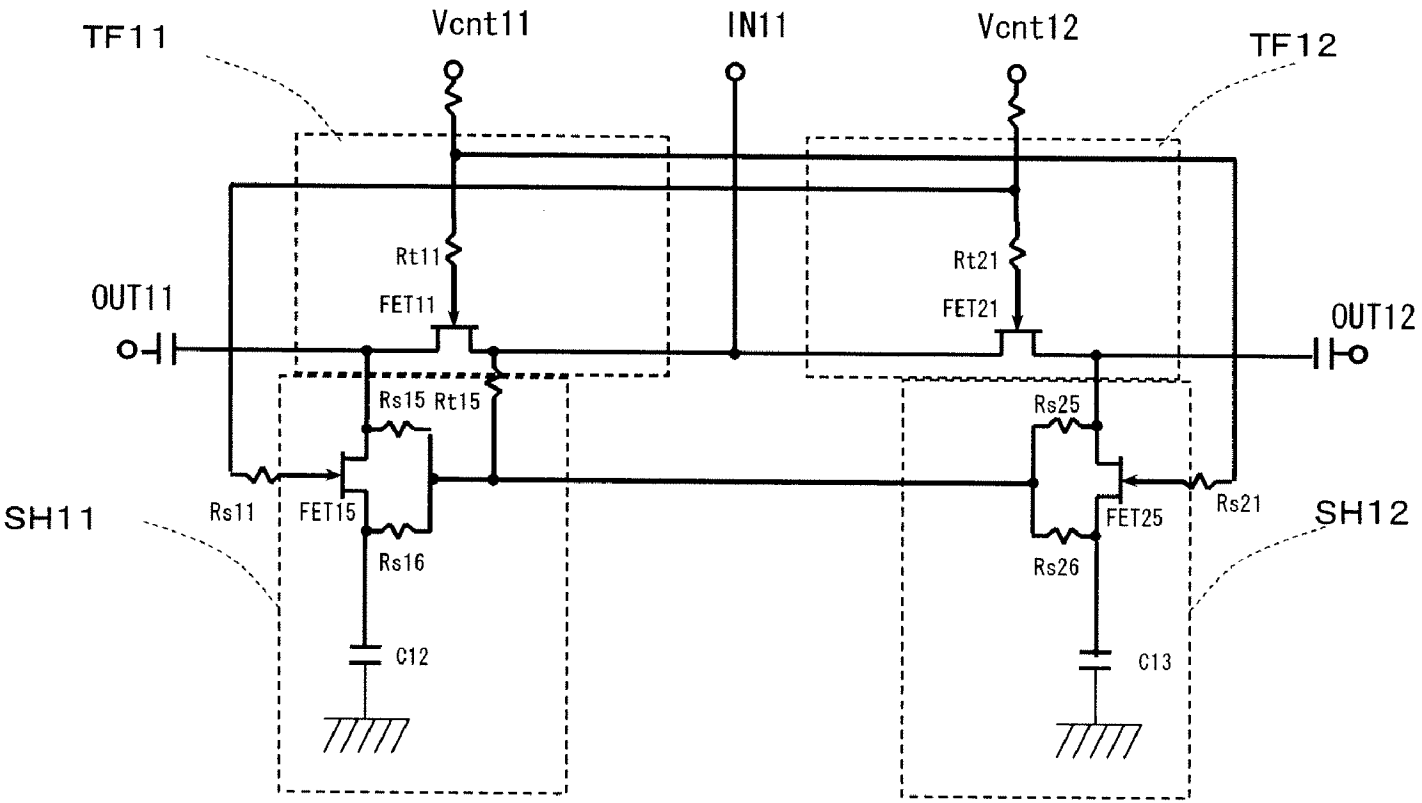
FIG. 18 PRIOR ART
FIG. 18 is a circuit diagram showing an equivalent circuit of a SPDT high-frequency switching apparatus according to another conventional art.

FIGS. 16A and 16B are a top perspective view and a cross-sectional view, respectively, of a SPDT high-frequency switching apparatus having another configuration, according to the fourth embodiment. In FIGS. 16A and 16B, reference numeral 101 denotes a semiconductor chip. Reference numerals 31 and 32 each denote a shunt circuit unit formed on a surface of the semiconductor chip 101. Reference numeral 43 denotes electrical wiring formed on the surface of the semiconductor chip 101. Reference numerals 53 and 55 denote electrodes formed on a backside of the semiconductor chip 101 so as to be insulated from each other. Reference numerals 54 and 56 each denote an electrode formed on the surface of the semiconductor chip 101. Reference numeral 65 denotes an electromagnetic wave absorption material element formed on the entire backside of the semiconductor chip 101. Reference numeral 91 denotes an inner via that connects the electrode 53 to the electrode 54. Reference numeral 92 denotes an inner via that connects the electrode 55 to the electrode 56.

As shown in FIGS. 16A and 16B, on the backside of the semiconductor chip 101, the electrode 55 is formed which is different from and electrically insulated from the electrode 53. The electrode 55 is formed on the backside of the semiconductor chip 101 so as to include, as viewed in a projective manner from the top surface, a portion where FETs, resistors, electrode pads, and wiring are formed on the surface of the semiconductor chip 101 as a switching circuit, particularly portions where transfer circuit units are formed. On the surface of the semiconductor chip 101, the electrode 56 is formed which serves both as an electrode used to establish a connection to a GND electrode which is an external component of the chip, and as a land electrode of the inner via 92. The electrodes 55 and 56 are electrically connected to each other via the inner via 92.

In the SPDT high-frequency switching apparatus configured in the above-described manner, since the potential at the substrate of the semiconductor chip 101 can be stabilized, a high-frequency switching apparatus which is excellent not only in isolation characteristics but also in high-frequency characteristics such as insertion loss can be implemented.

INDUSTRIAL APPLICABILITY

The high-frequency switching apparatuses of the present invention have advantageous effects of being able to improve the isolation characteristics as compared with conventional art apparatuses and to improve the ESD breakdown voltage, and thus are useful as, for example, high-frequency switching apparatuses that perform switching between a plurality of signal paths in mobile communication devices and the like.

What is claimed is:

1. A high-frequency switching apparatus comprising an input/output control circuit including:

a first and a second input/output terminals;

a transfer circuit unit composed of a first switching circuit and connected to the first input/output terminal at its one end and to the second input/output terminal at its other end, the first switching circuit including a first field-effect transistor;

a shunt circuit unit composed of a second switching circuit and connected to the second input/output terminal at its one end, the second switching circuit including a second field-effect transistor; and an electromagnetic wave absorption material element connected to an other end of the shunt circuit unit, wherein by applying one of a high level voltage and a low level voltage to a gate of the first field-effect transistor and a gate of the second field-effect transistor such that the applied voltages are in opposite phase, a path between the first input/output terminal and the second input/output terminal is switched between a conduction state and a cutoff state.

2. The high-frequency switching apparatus according to claim 1, wherein a plurality of the input/output control circuits are provided, and the first input/output terminals of the respective input/output control circuits are disposed into one first input/output terminal for shared use between the input/output control circuits, and the second input/output terminals of the respective input/output control circuits are disposed independently.

3. The high-frequency switching apparatus according to claim 2, wherein the electromagnetic wave absorption material element is provided for shared use between the input/output control circuits.

4. The high-frequency switching apparatus according to claim 3, wherein the other ends of the respective shunt circuit units included in the input/output control circuits are connected to a first electrode in a shared manner and the first electrode is connected to the electromagnetic wave absorption material element.

5. The high-frequency switching apparatus according to claim 1, wherein the input/output control circuit is formed on a semiconductor chip.

6. The high-frequency switching apparatus according to claim 1, wherein the electromagnetic wave absorption material element included in the input/output control circuit is formed on a first semiconductor chip, the input/output control circuit, excluding the electromagnetic wave absorption material element, is formed on a second semiconductor chip, and the first and the second semiconductor chips are packaged in a same package.

7. The high-frequency switching apparatus according to claim 1, wherein the input/output control circuit, excluding the electromagnetic wave absorption material element, is formed on a semiconductor chip, the electromagnetic wave absorption material element having a larger area than the semiconductor chip is formed on a mounting substrate, the semiconductor chip is mounted on the electromagnetic wave absorption material element, and the semiconductor chip is connected to the electromagnetic wave absorption material element via a second electrode formed on the electromagnetic wave absorption material element.

8. The high-frequency switching apparatus according to claim 7, wherein a third electrode is formed in a lower layer on the mounting substrate than the electromagnetic wave absorption material element, the third electrode is connected to a ground potential, and the second electrode is disposed on the electromagnetic wave absorption material element so as to face the third electrode.

9. The high-frequency switching apparatus according to claim 1, wherein the input/output control circuit, excluding the electromagnetic wave absorption material element, is formed on a surface of a semiconductor chip, an inner via connected to the shunt circuit unit is formed in the semiconductor chip, a second electrode is formed on a backside of the semiconductor chip, the inner via and the second electrode are connected to each other, and the electromagnetic wave absorption material element is formed on the backside of the semiconductor chip so as to include, as viewed in a projective manner from a top, the second electrode.

10. The high-frequency switching apparatus according to claim 1, wherein the input/output control circuit, excluding the electromagnetic wave absorption material element, is formed on a surface of a semiconductor chip, an inner via connected to the shunt circuit unit is formed in the semiconductor chip, a second electrode is formed on a backside of the semiconductor chip, the second electrode is connected to the inner via, and the electromagnetic wave absorption material element is formed so as to include an entire backside of the semiconductor chip.

11. The high-frequency switching apparatus according to claim 9, wherein the semiconductor chip is flip-chip mounted.

12. The high-frequency switching apparatus according to claim 10, wherein the semiconductor chip is flip-chip mounted.

13. The high-frequency switching apparatus according to claim 7, wherein a third electrode connected to a ground potential is formed between the semiconductor chip and the electromagnetic wave absorption material element, and the third electrode is insulated from the second electrode.

14. The high-frequency switching apparatus according to claim 8, wherein a fourth electrode connected to the ground potential is formed between the semiconductor chip and the electromagnetic wave absorption material element, and the fourth electrode is insulated from the second electrode.

15. The high-frequency switching apparatus according to claim 9, wherein a third electrode connected to a ground potential is formed between the semiconductor chip and the electromagnetic wave absorption material element, and the third electrode is insulated from the second electrode.

16. The high-frequency switching apparatus according to claim 10, wherein a third electrode connected to a ground potential is formed between the semiconductor chip and the electromagnetic wave absorption material element, and the third electrode is insulated from the second electrode.

17. The high-frequency switching apparatus according to claim 1, wherein a potential at a connection point between the shunt circuit unit and the electromagnetic wave absorption material element is fixed.

18. The high-frequency switching apparatus according to claim 1, wherein the first switching circuit is composed of a circuit in which a plurality of the first field-effect transistors are connected to one another in series and the second switching circuit is composed of a circuit in which a plurality of the second field-effect transistors are connected to one another in series.

* * * * *